US007094066B2

(12) United States Patent
Mendenhall et al.

(10) Patent No.: US 7,094,066 B2
(45) Date of Patent: Aug. 22, 2006

(54) ELECTRICAL CONNECTOR

(75) Inventors: David W. Mendenhall, Naperville, IL (US); Hecham K. Elkhatib, Aurora, IL (US); Richard Miklinski, Jr., Aurora, IL (US)

(73) Assignee: Cinch Connectors, Inc., Lombard, IL (US)

( * ) Notice: Subject to any disclaimer, the term of this patent is extended or adjusted under 35 U.S.C. 154(b) by 0 days.

(21) Appl. No.: 11/028,855

(22) Filed: Jan. 4, 2005

(65) Prior Publication Data

US 2005/0118888 A1 Jun. 2, 2005

Related U.S. Application Data

(62) Division of application No. 10/458,909, filed on Jun. 11, 2003, now Pat. No. 6,921,270.

(51) Int. Cl.
*H01R 12/00* (2006.01)

(52) U.S. Cl. ..... 439/66; 439/733.1; 439/741

(58) Field of Classification Search ..... 439/733.1, 439/741–744, 66

See application file for complete search history.

(56) References Cited

U.S. PATENT DOCUMENTS

| | | | |
|---|---|---|---|
| 3,643,135 | A | 2/1972 | Devore et al. |
| 3,720,907 | A | 3/1973 | Asick |
| 3,873,173 | A | 3/1975 | Anhalt |
| 4,050,755 | A | 9/1977 | Hasircoglu |
| 4,052,118 | A | 10/1977 | Scheingold et al. |
| 4,371,228 | A | 2/1983 | Chalmers |
| 4,504,887 | A | 3/1985 | Bakermans et al. |
| 4,511,197 | A | 4/1985 | Grabbe et al. |
| 4,513,353 | A | 4/1985 | Bakermans et al. |
| RE32,370 | E | 3/1987 | Bright et al. |
| 4,647,124 | A | 3/1987 | Kandybowski |
| 4,684,184 | A | 8/1987 | Grabbe et al. |
| 4,906,194 | A | 3/1990 | Grabbe |
| 4,927,369 | A | 5/1990 | Grabbe et al. |
| 5,092,783 | A | 3/1992 | Suarez et al. |
| 5,139,427 | A | 8/1992 | Boyd et al. |
| 5,152,694 | A | 10/1992 | Bargain |

(Continued)

FOREIGN PATENT DOCUMENTS

EP 0 359 223 A1 9/1989

(Continued)

OTHER PUBLICATIONS

Plated Through-Hole Contact by H. C Schick, IBM Technical Disclosure Bulletin, vol. 6, No. 10, Mar. 1964, pp. 5-6.

*Primary Examiner*—Truc Nguyen
(74) *Attorney, Agent, or Firm*—Leydig, Voit & Mayer, Ltd.

(57) ABSTRACT

Provided is an electrical connector having first and second surfaces and configured to establish electrical communication between two or more electrical devices. The electrical connector includes an insulative housing and a resilient, conductive contact retained in an aperture disposed from the first surface to the second surface. To contact the electrical devices, the contact includes a center portion from which extends two diverging, cantilevered spring arms that project beyond either surface of the electrical connector. To shorten the path that current must travel through the contact, one spring arm terminates in a bellows leg that extends proximate to the second spring arm. When placed between the electrical devices, the spring arms are deflected together causing the bellows leg to press against the second spring arm. For retaining the contact within the aperture, the contact also includes retention members extending from the center portion that engage the insulative housing.

80 Claims, 31 Drawing Sheets

U.S. PATENT DOCUMENTS

| | | | |
|---|---|---|---|
| 5,181,852 | A | 1/1993 | Dambach et al. |
| 5,199,889 | A | 4/1993 | McDevitt, Jr. |
| 5,230,632 | A | 7/1993 | Baumberger et al. |
| 5,242,314 | A | 9/1993 | Di Giulio et al. |
| 5,308,252 | A | 5/1994 | Mroczkowski et al. |
| 5,324,205 | A | 6/1994 | Ahmad et al. |
| 5,342,205 | A | 8/1994 | Hashiguchi |
| 5,395,252 | A | 3/1995 | White |
| 5,437,556 | A | 8/1995 | Bargain et al. |
| 5,653,598 | A | 8/1997 | Grabbe |
| 5,653,600 | A | 8/1997 | Ollivier |
| 5,713,744 | A | 2/1998 | Laub |
| 5,820,389 | A | 10/1998 | Hashiguchi |
| 5,951,303 | A | 9/1999 | Sudmöller |
| 5,957,703 | A | 9/1999 | Arai et al. |
| 5,980,268 | A | 11/1999 | Michenko et al. |
| 5,980,323 | A | 11/1999 | Bricaud et al. |
| 5,984,693 | A | 11/1999 | McHugh et al. |
| 5,997,315 | A | 12/1999 | Akama et al. |
| 6,027,345 | A | 2/2000 | McHugh et al. |
| 6,068,514 | A | 5/2000 | Zuin |
| 6,077,089 | A | 6/2000 | Bishop et al. |
| 6,146,152 | A | 11/2000 | McHugh et al. |
| 6,176,707 | B1 | 1/2001 | Neidich et al. |
| 6,183,267 | B1 | 2/2001 | Marcus et al. |
| 6,186,797 | B1 | 2/2001 | Wang et al. |
| 6,217,342 | B1 | 4/2001 | Neidich et al. |
| 6,227,869 | B1 | 5/2001 | Lin et al. |
| 6,231,353 | B1 | 5/2001 | Rathburn |
| 6,257,899 | B1 | 7/2001 | Walkup |
| 6,273,731 | B1 | 8/2001 | Bishop et al. |
| 6,280,254 | B1 | 8/2001 | Wu et al. |
| 6,290,507 | B1 | 9/2001 | Neidich et al. |
| 6,293,805 | B1 | 9/2001 | Wu |
| 6,296,495 | B1 | 10/2001 | Wang et al. |
| 6,302,702 | B1 | 10/2001 | Audet et al. |
| 6,315,576 | B1 | 11/2001 | Neidich |
| 6,358,063 | B1 | 3/2002 | Neidich |
| 6,821,163 | B1 * | 11/2004 | McHugh et al. ..... 439/733.1 |
| 6,851,986 | B1 * | 2/2005 | Zhao ..... 439/744 |
| 6,866,520 | B1 * | 3/2005 | Chiang ..... 439/66 |

FOREIGN PATENT DOCUMENTS

| | | |
|---|---|---|
| EP | 0 914 028 A2 | 6/1999 |
| GB | 834139 | 5/1960 |
| WO | WO 02/15342 A2 | 2/2002 |

* cited by examiner

ELECTRICAL CONNECTOR

This application is a divisional application of U.S. patent application Ser. No. 10/458,909 filed on Jun. 11, 2003 now U.S. Pat. No. 6,921,270, which is incorporated herein by reference.

FIELD OF THE INVENTION

The present invention relates generally to electrical coupling and, more particularly to electrical connectors having conductive contacts. The invention has particular utility in the field of electrically interconnecting circuit-carrying elements.

BACKGROUND OF THE INVENTION

Numerous styles of electrical connectors are commonly used to electrically couple two or more circuit-carrying elements. For example, electrical connectors are often used to provide a conductive path between contact pads on an integrated circuit package and conductive traces on a substrate, such as a printed circuit board. A typical connector used for this situation and similar situations includes a low profile, insulative housing that retains a plurality of conductive contacts and can be placed between the integrated circuit package and the substrate. The contacts protrude beyond respective surfaces of the housing to simultaneously touch the contact pads and conductive traces when the integrated circuit package and substrate are pressed together.

Preferably, the contacts have a resilient quality and can thereby deform between and urge back against the pads and traces. As a related issue, the contacts should provide a substantial range of deflection to be compatible with various styles of housings, pads, and traces. It is also preferable that the conductive path which the electric current must travel across the housing be as direct and short as possible. Furthermore, the contact should be shaped and retained in the housing in a manner that optimizes electrical contact between the contact and the pad and conductive trace. Thus, there is a need for an improved electrical contact that provides the desired resiliency, range, shortened electrical path, and optimized contact.

SUMMARY OF THE PRESENT INVENTION

The present invention provides a resilient contact that can be retained in an aperture disposed through an insulative housing to form an assembled electrical connector. The contact has a center portion from which two cantilevered spring arms extend in a diverging manner. The ends of each spring arm define a land surface that protrudes beyond the surfaces of the housing to contact a contact pad or conductive trace. To shorten the electrical path through the contact, there is extending from the end of one spring arm in a direction towards the second spring arm an elongated bellows leg. The portion of the bellows leg in proximity to the second spring arm defines a first contact surface that opposes a similar second contact surface defined as part of the second spring arm.

When the contact pad and conductive trace are pressed toward one another, the cantilevered spring arms are likewise deflected towards each other. The two contact surfaces are thereby pressed together to produce the shortened electrical path. To prevent the contact surfaces from abrasively sliding against each other, each contact surface is preferably formed with a curved shape. When pressed together, the apexes of the curved shapes contact each other. To allow the apexes to slide smoothly over each other, the bellows leg is formed to afford a resiliency that allows the second contact surface to slide over the bellows leg thereby providing for continued deflection of the spring arms. Preferably, the direction of sliding motion between the second contact surface and the bellows leg is normal to the plane in which the spring arms deflect In another aspect of the invention, to retain the contact within the insulative housing, the contact can have retention members extending outwardly from the sides of the center portion. In an embodiment, the retention members can be configured to engage the insulative housing in a manner that allows the contact to float with respect to the aperture so that the contact can adjust to the locations of the contact pads and the conductive traces. In an embodiment, the retention members can be configured to rigidly join the contact to the insulative housing.

DETAILED DESCRIPTION OF THE DRAWINGS

Figure 1:
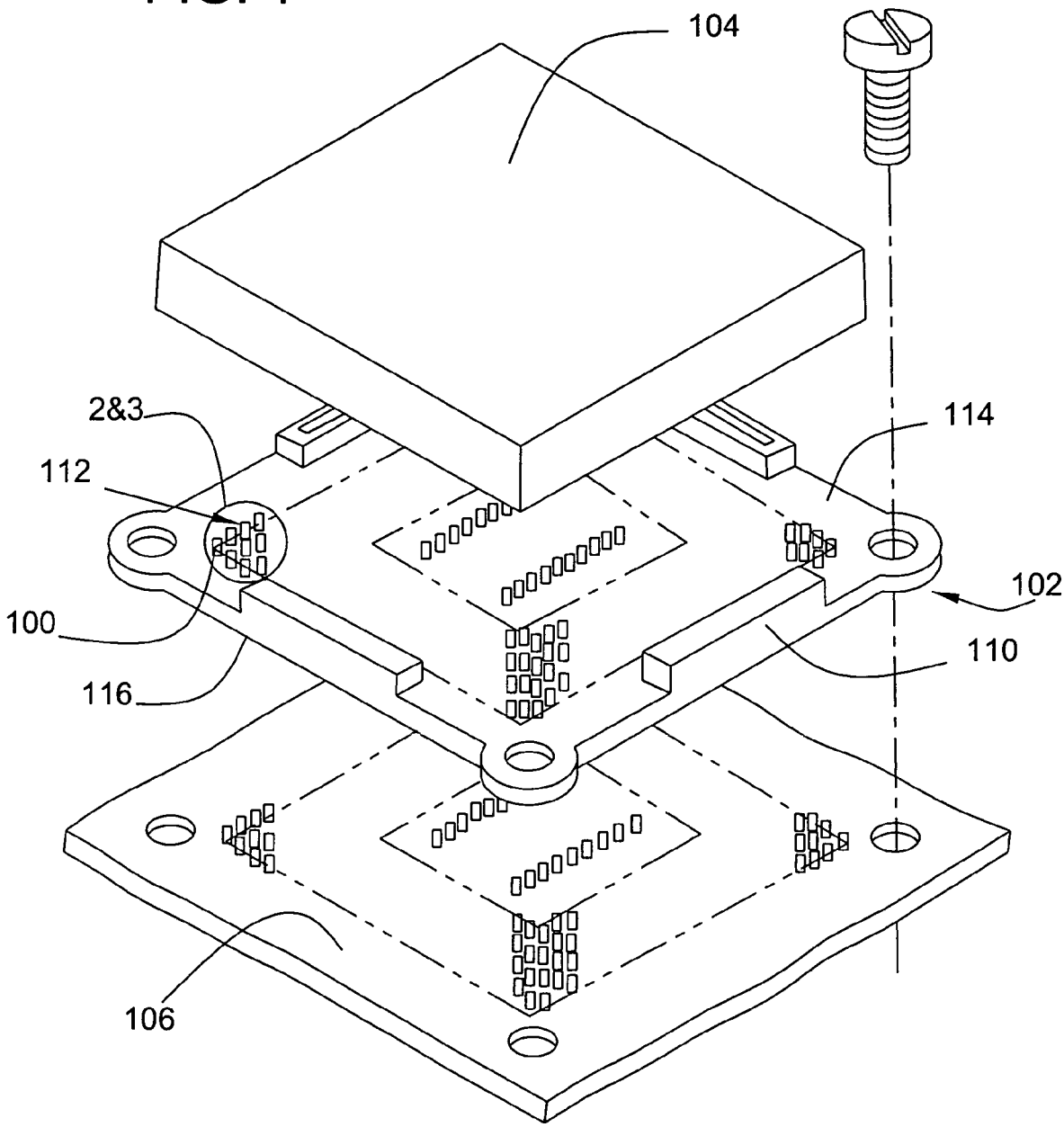
FIG. 1 is a perspective, exploded view illustrating an electrical connector having a contact according to the present invention for providing electrical communication between an integrated circuit package and a substrate.
Figure 2:
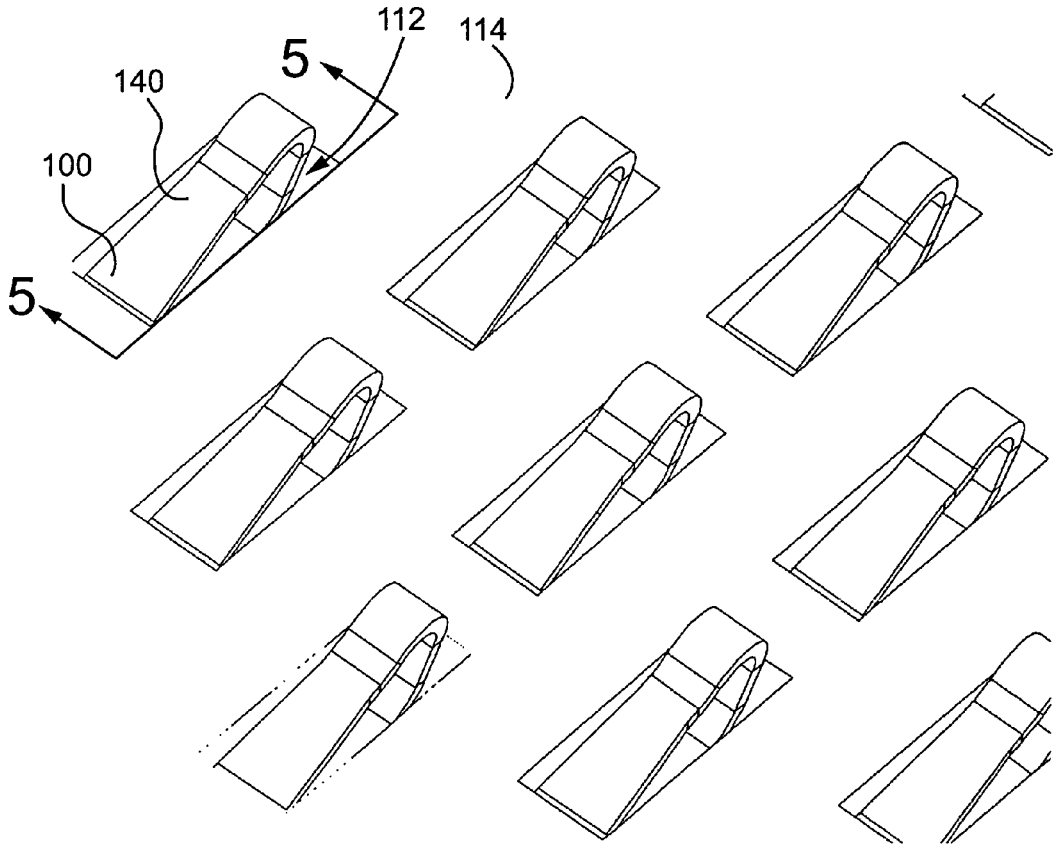
FIG. 2 is a detailed view of the indicated section of FIG. 1 illustrating the first surface of the housing including a contact inserted into an aperture.
Figure 3:
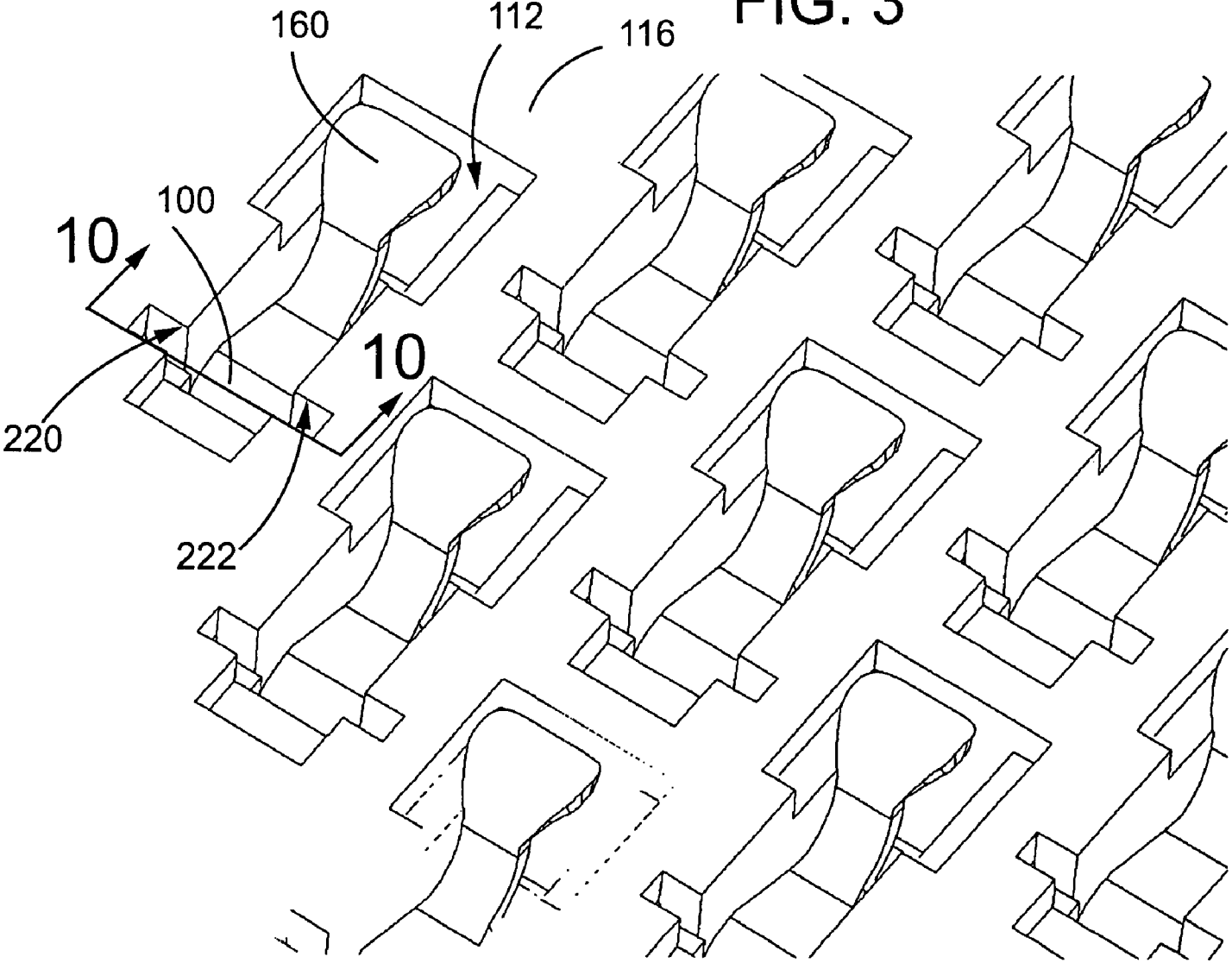
FIG. 3 is a detailed view taken opposite the view illustrated in FIG. 2 illustrating the opposing second surface of the housing.

Now referring to the drawings, wherein like reference numbers refer to like features, there is illustrated in FIG. 1 an exemplary electrical connector 102 configured for retaining an electrical contact of the present invention in an exemplary application. The electrical connector is located between an integrated circuit package 104 that includes a plurality of electrically conductive contact pads or lands and a substrate 106 that includes one or more conductive traces. To provide electrical communication between the contact pads of the integrated circuit package 104 and the electrical traces of the substrate 106, the electrical connector 102 includes a plurality of electrical contacts 100 retained in an insulative housing 110. As illustrated in FIG. 1, to retain the contacts 100, the insulative housing 110 includes a plurality of apertures 112 disposed therethrough from a first surface 114 to a second surface 116. The apertures 112 are arranged to correspond to the locations of the contact pads of the integrated circuit package 104 and the conductive traces of the substrate 106. As illustrated in FIGS. 2 and 3, when the contact 100 is appropriately inserted into the aperture 112, parts of the contact project from both the first and second surfaces and are therefore capable of making electrical contact with the contact pads and conductive traces.

While the present invention is described in the context of providing electronic coupling between an integrated circuit package and substrate, it will be readily appreciated that the invention is equally applicable to electronic coupling between other types of electrical components, such as, between two circuit-carrying substrates.

Figure 4:
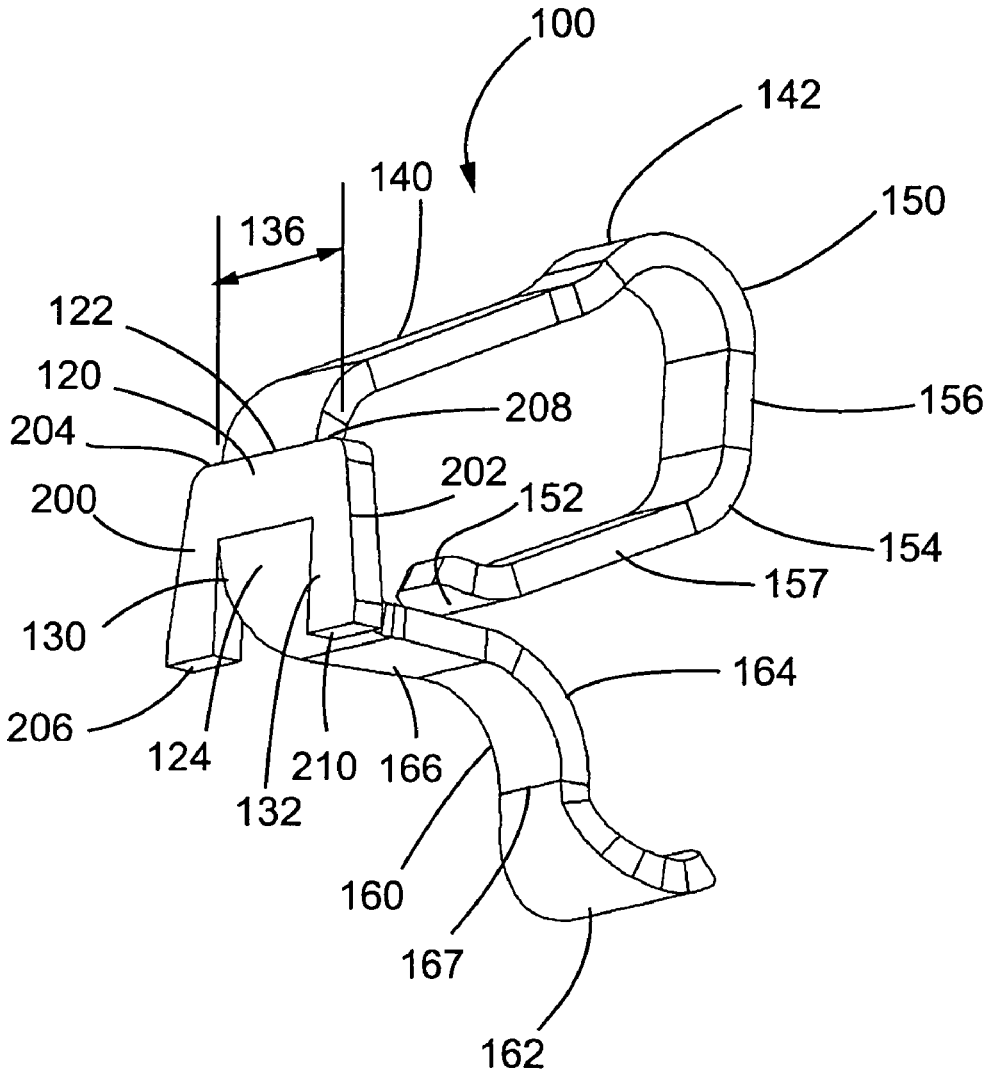
FIG. 4 is a perspective view of the electrical contact as formed.

An embodiment of the electrical contact 100 is better illustrated in FIG. 4. The electrical contact 100 has a generally planer center portion 120 defined by an upper end 122 and a lower end 124. For purposes of orientation, the upper end 122 will define an upwards direction with respect to the electrical contact and the lower end 124 will define a downwards direction with respect to the electrical contact 100. However, the terms "upwards" and "downwards" are relative and in no way should be construed as a limitation of the inventive electrical contact. The center portion 120 is further defined by a first side 130 and a second side 132 that extend between the upper and lower ends 122, 124 such that the center portion has a given width 136. In the illustrated embodiment, the width of the center portion 120 may be approximately 0.024 inches.

Figure 5:
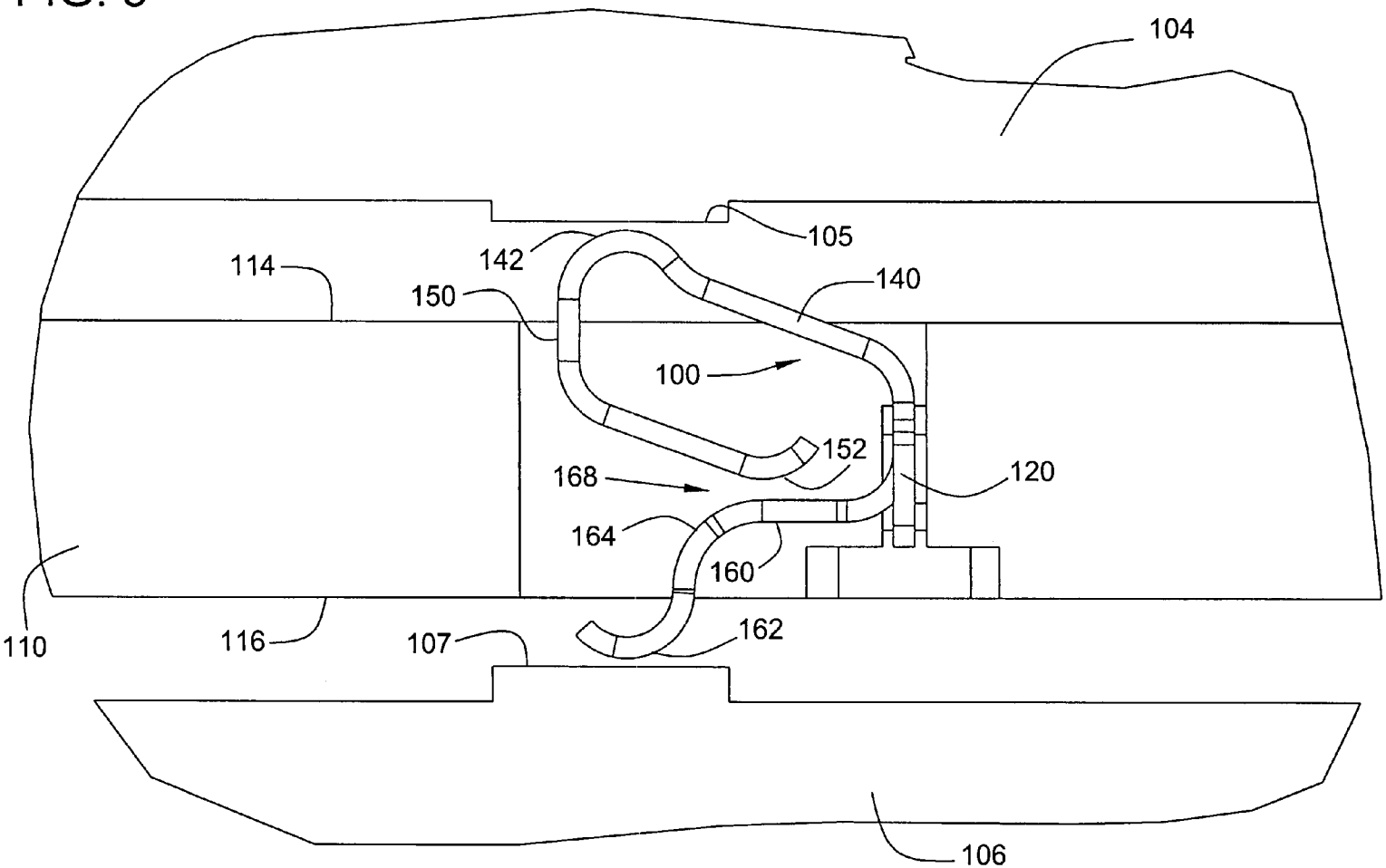
FIG. 5 is a cross-sectional view taken along lines 5—5 of FIG. 2 illustrating the un-deflected contact retained in the aperture of the insulative housing and also illustrating the integrated circuit package and the substrate.
Figure 6:
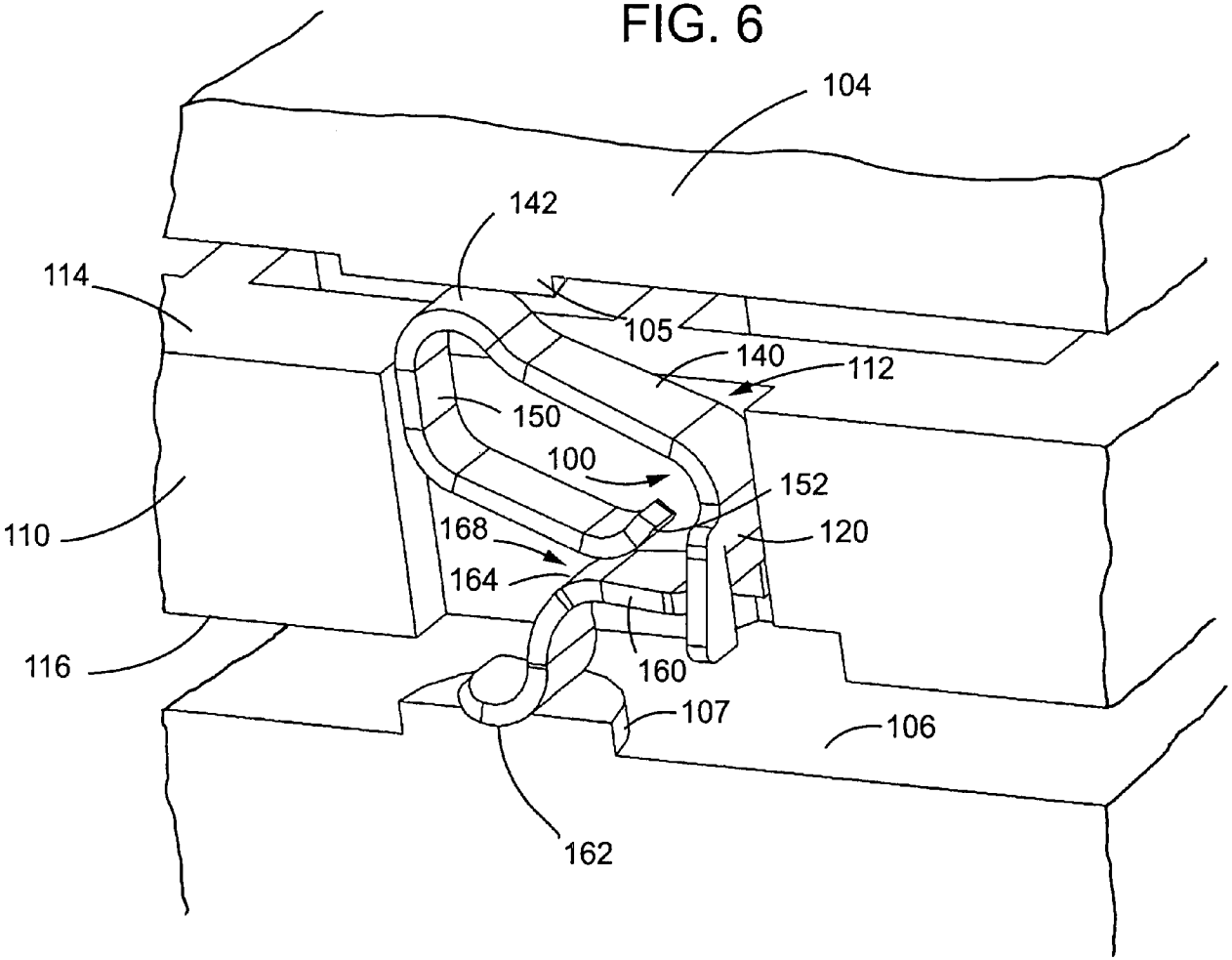
FIG. 6 is a perspective view of the cross-sectional view illustrated in FIG. 5.

Extending at an angled, upwards direction from the upper end 122 is a first spring arm 140. The first spring arm 140 is attached to the center portion 120 in a cantilevered fashion such that the first spring arm can deflect with respect to the center portion. The first spring arm 140 terminates in a curved first land surface 142 at a location above the upper end 122. Therefore, as illustrated in FIGS. 5 and 6, when the electrical contact 100 is correctly placed in the aperture 112, the first land surface 142 projects above the first surface of the housing proximate to a pad 105 on the integrated circuit package 104.

Figure 7:
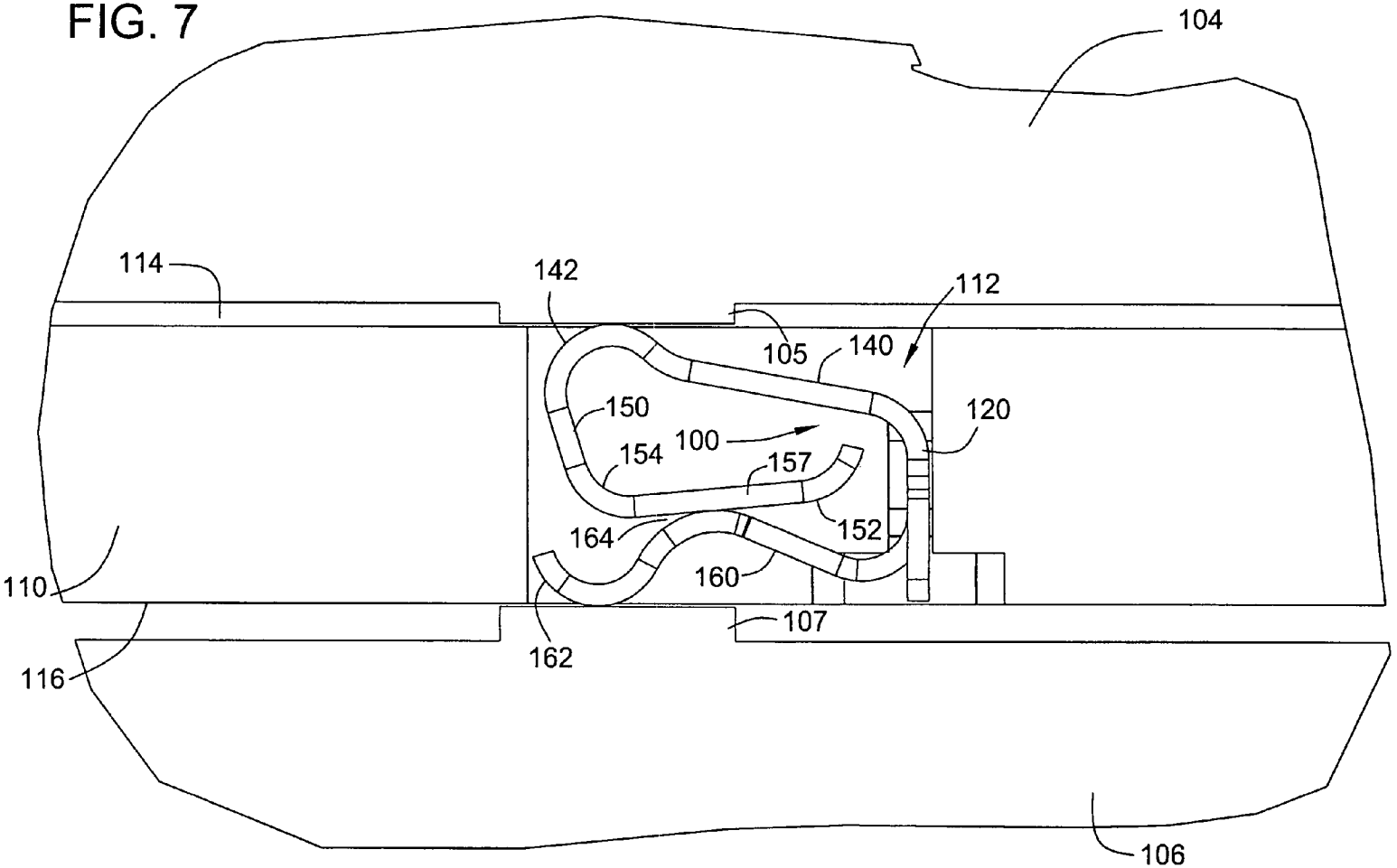
FIG. 7 is a cross-sectional view similar to FIG. 5 illustrating the contact as deflected between the integrated circuit package and the substrate.
Figure 8:
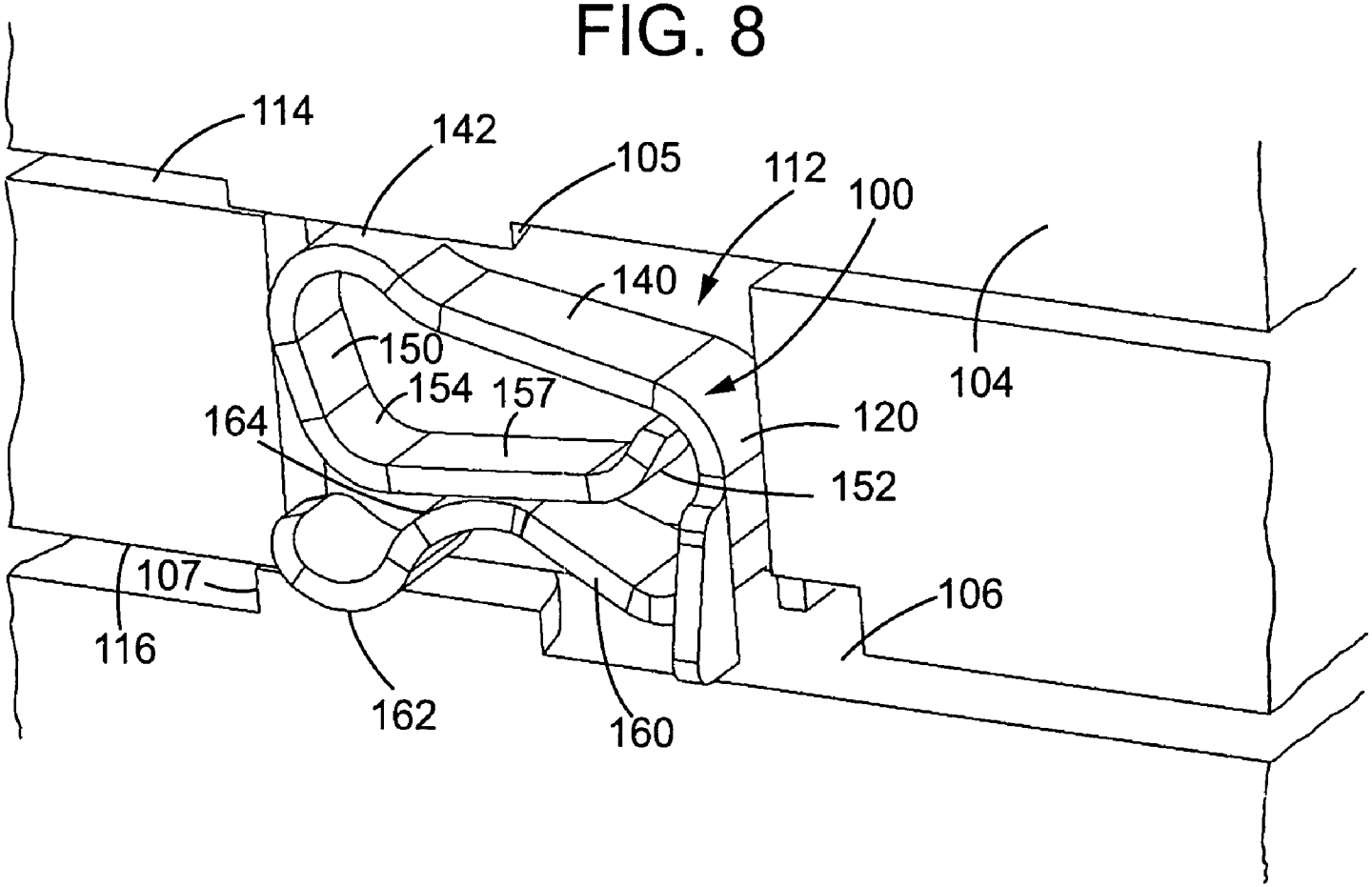
FIG. 8 is a perspective view of the cross-sectional view illustrated in FIG. 7.

Referring to FIGS. 7 and 8, as the integrated circuit package 104 is pressed or clamped to the first surface 114 of the insulative housing 110, the pad 105 causes the first spring arm 140 to deflect downward with respect to the center portion 120. In fact, the first spring arm 140 may be deflected partially or wholly into the aperture 112. Because of the cantilevered nature of the first spring arm 140 and the resiliency of the contact material, the deflected first spring arm 140 exerts an upward contact force against the pad 105 ensuring an adequate electrical connection.

As shown in FIGS. 7 and 8, the contact pad 105 tangentially contacts the curved first land surface 142 thereby concentrating the contact force produced by the cantilevered first spring arm. Additionally, because of the curved shape of the first land surface 142, there is less of a tendency for the first land surface to pierce or penetrate the contact pad 105. Furthermore, the first land surface 142 and the first spring arm 140 can be formed with substantially the same width as the center portion 120. Thus, in such embodiments, the width of the first land surface 142 provides a sufficient dimension for the contact pad 105 to contact.

Referring to FIG. 4, extending generally downwards from the first land surface 142 is a bellows leg 150. In the illustrated embodiment, the bellows leg 150 includes a first portion 156 that extends generally parallel to the center portion 120 and a second portion 157 that extends generally parallel to the first spring arm 140. The first and second portions 156, 157 are joined together at a bend 154 that approximately corresponds to the vertically position of the center portion 120. In the illustrated embodiment, the angle of the bend is less than 90 degrees so that the second portion continues to extend generally downward with respect to the center portion. The bellows leg 150 terminates in a first contact surface 152 that curves slightly upwards toward the first spring arm 140. The first contact surface 152 can be located above or below the lower end 124 of the center portion 120. As illustrated, the first contact surface 152 and the bellows leg 150 can be formed with the same width as the center portion 120 and the first spring arm 140.

Referring to FIG. 4, extending from the lower end 124 of the center portion 120 is a second spring arm 160 that terminates in a second land surface 162. The second spring arm 160 includes a first portion 166 attached to the lower end 124 in a cantilevered fashion. The first portion 166 is also attached to a second portion 167 by a curve 164 that directs the second portion generally downwards. As such, in the illustrated embodiment, the second land surface 162 is below the lower end 124. Therefore, as illustrated in FIGS. 5 and 6, when the electrical contact 100 is correctly placed in the aperture 112, the second land surface 162 projects below the second surface 116 of the insulative housing 112 proximate to an electrical trace 107 on the substrate 106. Furthermore, because of the cantilevered fashion in which the second spring arm 160 is attached to the center portion 120, the second spring arm can deflect with respect to the center portion.

Referring to FIGS. 7 and 8, as the substrate 106 is pressed or clamped to the second surface 116 of the insulative housing 110, the electrical trace 107 causes the second spring arm 160 to deflect upwards with respect to the center portion 120. In fact, the second spring arm 160 may be deflected partially or wholly into the aperture 112. Because of the cantilevered nature of the second spring arm 160 and the resiliency of the contact material, the deflected second spring arm exerts a downward contact force against the electrical trace 107 ensuring an adequate electrical connection.

To optimize contact between the electrical trace 107 and the second land surface 162, the second land surface is shaped to curve slightly upwards. As will be appreciated, the electrical trace 107 tangentially contacts the apex of the curved second land surface 162 thereby concentrating the contact force produced by the second spring arm 160. Additionally, because of the smooth, curved shape of the second land surface 162, there is less of a tendency for the second land surface to pierce or penetrate the electrical trace 107. Furthermore, the second land surface 162 can be formed with a width equal to or, as illustrated, greater than the width of the center portion 120. Thus, in such embodiments, the width of the second land surface 162 provides a sufficient dimension for the electrical trace 107 to make contact with.

Referring to FIG. 4, the curve 164 can function as a second contact surface that is located between the first portion 166 and the second portion 167. Preferably, the second contact surface 164 is located approximately below the first contact surface 152 so that the two contact surfaces appear, as illustrated in FIGS. 5 and 6, as opposing curves. In the embodiment illustrated in FIGS. 5 and 6, the first and second contact surfaces 152, 164 are separated by a gap 168. An advantage of providing the gap 168 is that the first and second contact surfaces 152, 164 can be easily plated during production of the contact.

Referring to FIGS. 7 and 8, when the first and second spring arms 140, 160 are deflected towards each other by the integrated circuit package and/or substrate, the first contact surface 152 is pressed against the second contact surface 164 thereby eliminating the gap. This results in shortening the path electric current must travel through the contact 100. Since contact between the bellows leg 150 and spring arm 160 occurs tangentially along the apex of the curved first contact surface 152 and the curved second contact surface 164, abrasion and the likelihood of damaging or fusing together of the first and second contact surfaces is reduced. When the forces causing the spring arms to deflect are removed, the resiliency of the contact material can cause the contact surfaces 152, 164 to separate re-creating the gap 168 illustrated in FIGS. 5 and 6. Furthermore, where the widths of the bellows leg 150 and second spring arm 160 are similar to or the same as the center portion 120, the contact surfaces will have an adequate dimension across which contact can occur.

Preferably, referring to FIGS. 2, 3, 5 and 6, the first and second spring arms 140, 160 do not project a substantial amount beyond the first and second surfaces 114, 116 of the insulative housing 110. This reduces the chance that the spring arms 140, 160 will be overly strained during deflection and thereby avoid becoming permanently deformed. This also reduces the chance that the projecting spring arms 140, 160 will be bent or otherwise damaged due to unintentional contact with a foreign object.

Referring to FIGS. 5 and 6, it will be noted that because the second contact surface 164 is located within the length of the second spring arm 160 and has substantially the same width as the center portion 120, there is a sufficient amount of surface area for the first contact surface 152 to press against. In other words, precise alignment between the first and second contact surface 152, 164 is not required. Additionally, it will be appreciated that the bellows leg 150 and first contact surface 152 function to press the second spring arm downwards against the electrical trace 107.

Referring to FIGS. 7 and 8, to allow the first and second spring arms 140, 160 to be further deflected toward each other after the initial contact between the first and second contact surfaces 152, 164, the second spring arm and the bellows leg 150 can be configured to allow the second contact surface 164 to slide along the bellows leg. More specifically, the resilient nature of the contact material allows the bellows leg 150 to bend upon itself at the first land surface 142 and the bend 154. Therefore, after the initial contact, the second contact surface 164 can slide along the second portion 157 of the bellows leg 150 as the bellows leg is displaced upwards toward the first spring arm 140. Accordingly, the first contact surface 152 is directed towards the center portion 120 as the bellows leg 150 bends. An advantage of enabling sliding motion of the second contact surface 164 along the first portion 157 is that it provides for a greater range of deflection between the spring arms 140, 160. Another advantage of enabling sliding motion of the second contact surface 164 with respect to the first contact surface 152 is that the contact surfaces can be wiped clean of any built-up debris that could hinder electrical communication across the contact surfaces. When the forces causing deflection of the spring arms are removed, the second contact surface 164 can slide back along the bellows leg 154 thereby causing the contact 100 to recover its initial un-deflected shape.

Figure 9:
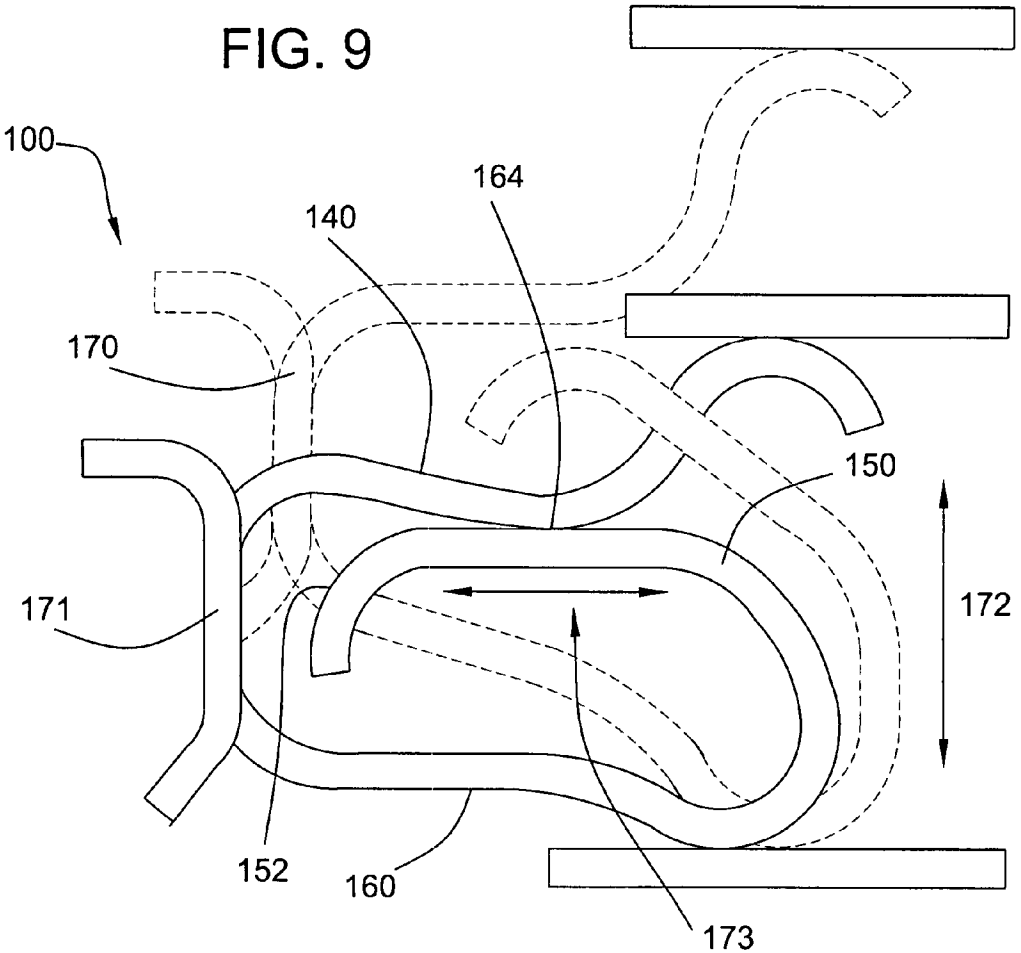
FIG. 9 is a side elevational view illustrating the forces exerted during deflection of the contact.

Another advantage of the inventive contact 100 is demonstrated by reference to FIG. 9, which illustrates the contact 100 in both its initial un-deflected shape 170 and deflected shape 171. In a preferred embodiment, the direction of the sliding motion between the second contact surface 164 and the bellows leg 150 is normal to the plane in which the first and second spring arms 140, 160 deflect. This preferred configuration enhances the contact's ability to recover its initial un-deflected shape when the forces deflecting the first and second spring arms 140, 160 are removed. During the initial deflection, the deflecting forces must exceed the upwards and downwards resiliency forces generated by the spring arms 140, 160. The vectors representing the deflecting forces and the resiliency forces are oriented in a vertical plane as indicated by the arrow 172.

As the first and second contact surfaces 152, 164 contact and slide along each other, a frictional force is generated that the deflecting forces must additionally overcome. The force vectors for the frictional forces, however, are substantially oriented in a horizontal plane as indicated by arrow 173, and are therefore normal to the deflecting forces. Accordingly, the frictional forces do not substantially oppose the vertical deflecting forces. When the deflecting forces are removed and the resiliency forces displace the first and second spring arms 140, 160 to their initial positions, the frictional forces will attempt to resist the sliding motion of the second contact surface 164 along the bellows leg 150. Again though, because the frictional resistance forces are normal to the resiliency forces, they will not substantially affect recovery of the contact.

Figure 10:
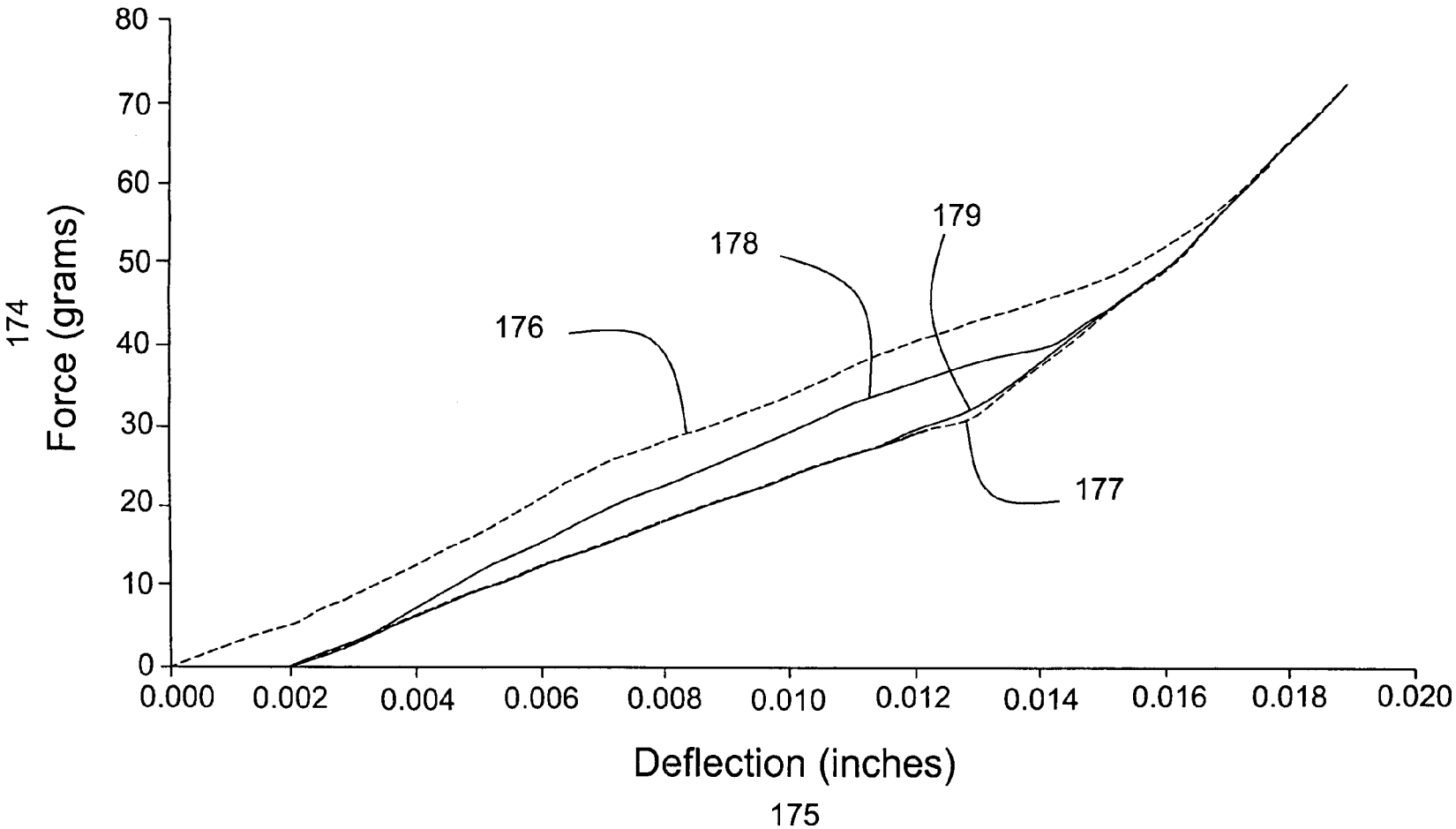
FIG. 10 is a graph depicting the forces exerted in FIG. 9.

The relationship between force and displacement for the illustrated contact can be represented by the graph shown in FIG. 10 in which force 174 is represented by the vertical axis while displacement 175 is represented by the horizontal axis. The graph of FIG. 10 is a representation of data generated by computer-aided finite element analysis simulations of the inventive contact. The curve 176 represents the force and displacement relations for the initial deflection of the spring arms together while curve 177 represents the recovery of the spring arms. As represented, curve 176 originates from the horizontal axis left of where recovery curve 177 intersects the horizontal axis. This discrepancy represents cold working of the metal contact that occurs during the initial deflection cycle after the contact is manufactured. The imparted cold working results in a permanent set preventing the contact from fully recovering its pre-deflection shape.

Curve 178 represents any subsequent deflection of the spring arms together. As will be appreciated, recovery of the spring arms from the subsequent deflections as represented by curve 178 occurs along the subsequent recovery curve 179. Accordingly, after accounting for the initial cold working of the contact, the contact will generally return to the same shape. Moreover, the curve 178 generated during the subsequent deflections is substantially similar to the curve 179 generated during recovery.

Figure 11:
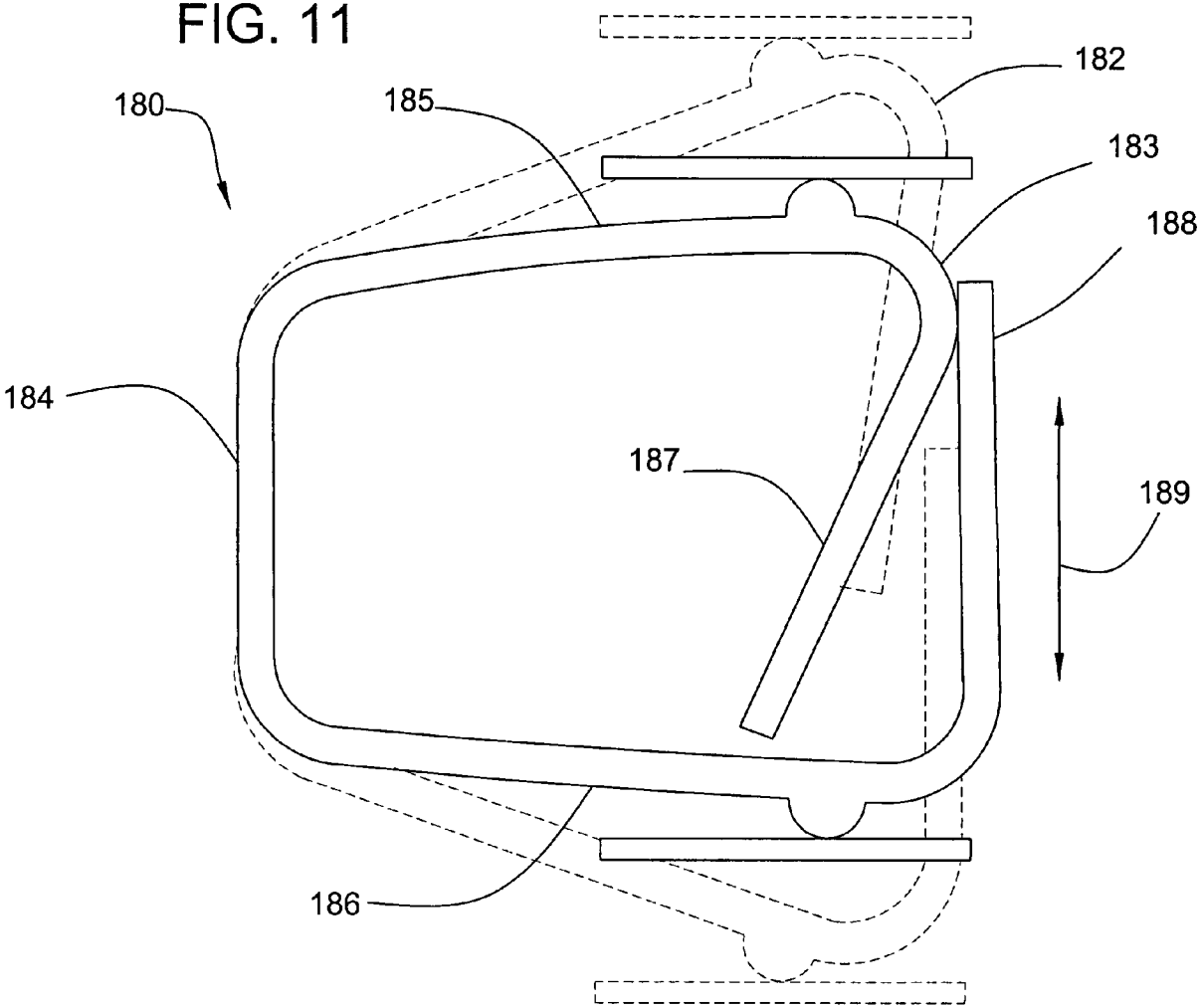
FIG. 11 is a side elevational view of a prior art contact illustrating the forces exerted during deflection of that contact.

It will be appreciated from the above that the inventive contact is a substantial improvement over prior art contacts in which the deflection, resiliency, and frictional forces are all oriented within the same plane. An example of such a prior art contact 180 is illustrated in FIG. 11 in both its initial un-deflected shape 182 and its deflected shape 183. The prior art contact 180 includes a center portion 184, opposing first and second resilient spring arms 185, 186, and inward extending fingers 187, 188 arranged at the free ends of each spring arm 185, 186. The fingers 187, 188 engage each other in an overlapping relationship. The deflection, resiliency, and frictional forces are all oriented in a vertical plane designated by the arrow 189. When the deflecting forces are removed and the first and second spring arms 185, 186 attempt to return to their initial positions, the frictional forces will resist the resiliency forces. If the resiliency forces are insufficient to overcome the frictional forces, the spring arms 185, 186 will not return to their initial positions.

Figure 12:
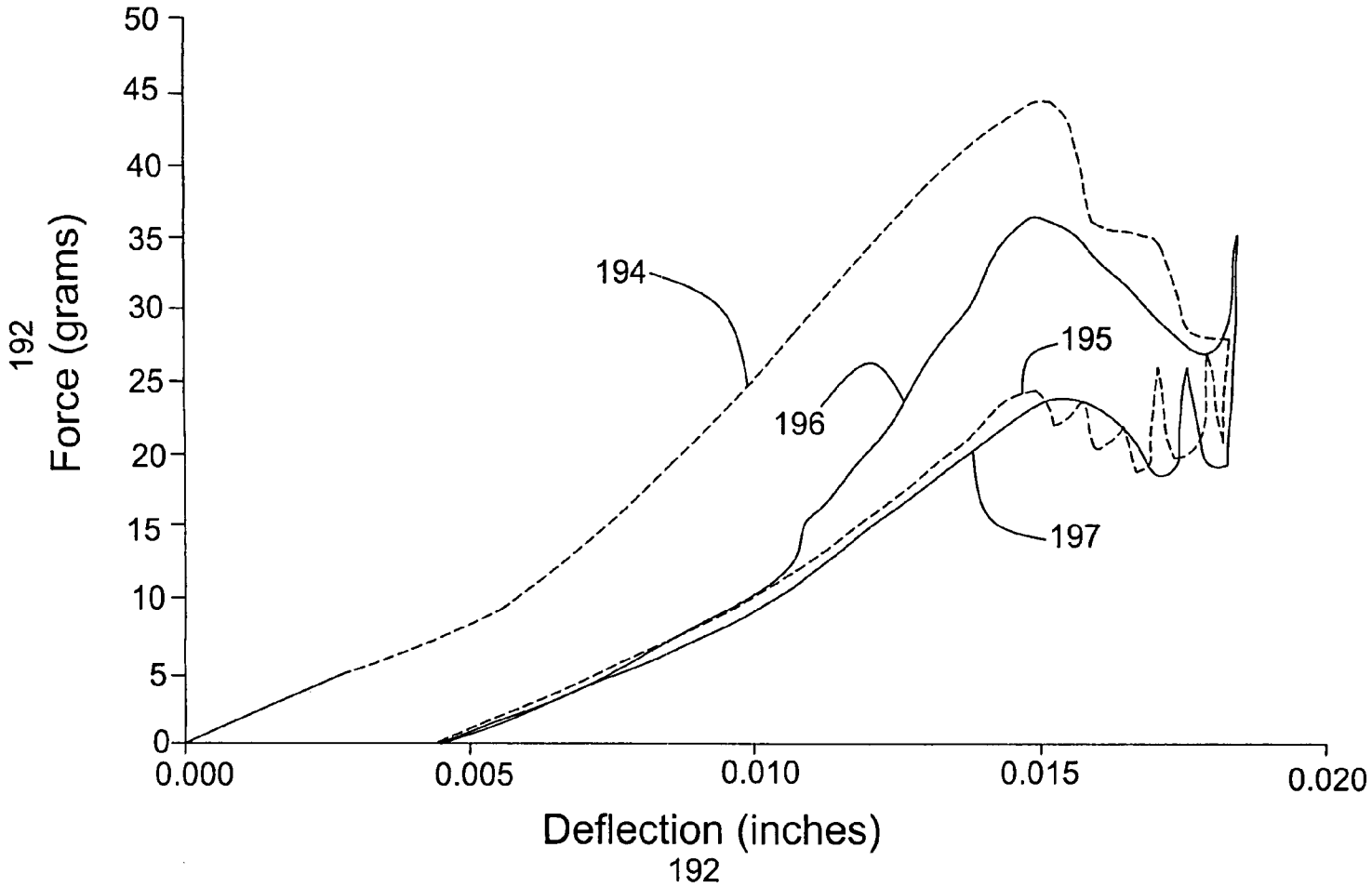
FIG. 12 is a graph depicting the forces exerted in FIG. 11.

The force vs. displacement graph for this contact is illustrated in FIG. 12, with force 190 represented by the vertical axis and displacement 192 represented by the horizontal axis. As before, a discrepancy exists between the curve 194 representing initial deflection and the curve representing recovery 195 due to the initial cold working of the contact and the permanent set induced. Subsequent deflections of the spring arms together are represented by curve 196 while subsequent recoveries are represented by curve 197. As illustrated, a substantial discrepancy exists between the curve 196 generated during subsequent deflections and the subsequent recovery curve 197, causing the two curves 196, 197 to form a hysteresis pattern. This hysteresis represents the resiliency force having to overcome the opposing frictional force. This problem is avoided by configuring the inventive contact 100 illustrated in FIG. 9 such that the friction forces are normal to the resiliency forces.

Figure 13:
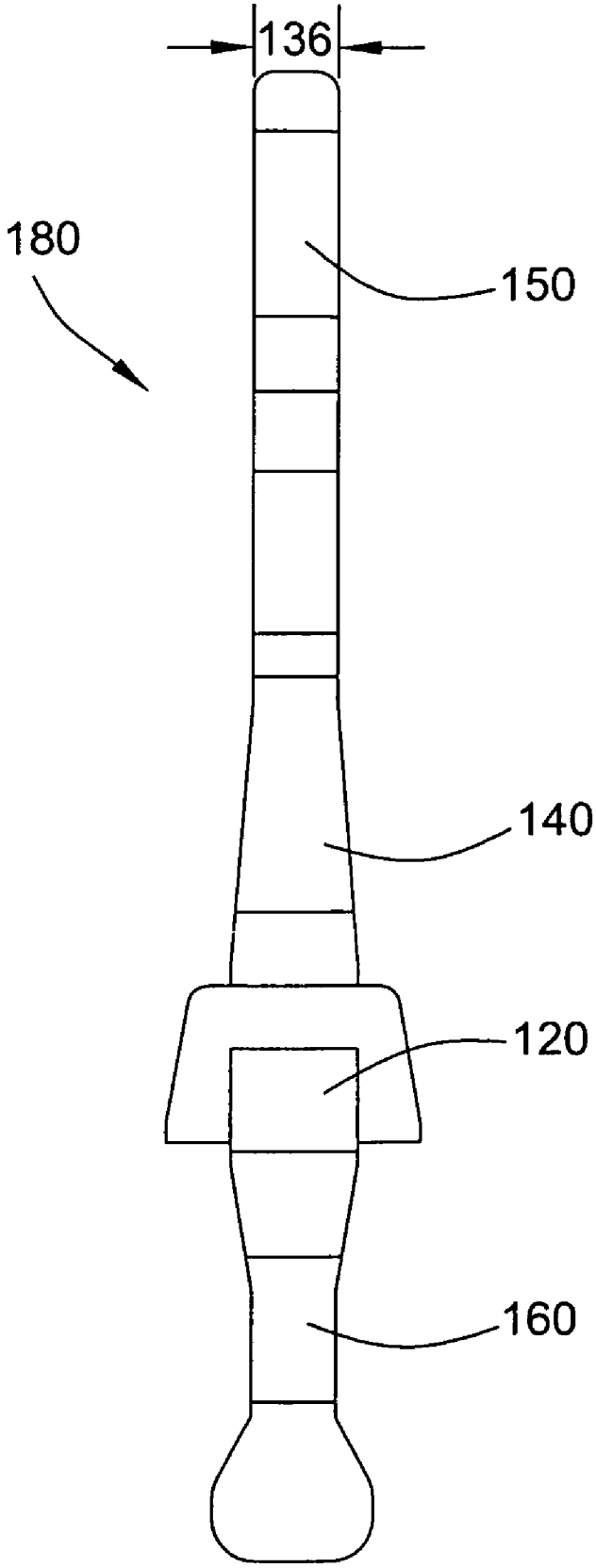
FIG. 13 is a top plan view of a blank stamped from sheet metal that is to be formed into the contact.

The electrical contact can be manufactured from any suitable conductive material that possesses the desirable resilient properties. Preferably, the contact is manufactured from metallic sheet material ranging between, for example, 0.0015–0.0030 inches in thickness. For example, as illustrated in FIG. 13, a planer blank 180 can be stamped from the sheet material that includes, in a flattened out arrangement, all the features of the contact including the center portion 120, spring arms 140, 160, and the bellows leg 150. Accordingly, stamping the blank 180 predetermines the width 136 of those features. The planer blank 180 can then be processed through a series of forming operations to form the shaped contact 100 illustrated in FIG. 4. The forming operations impart the curved shapes of the spring arms 140,160 and bellows leg 150 by permanently cold-working the sheet material. The use of sheet material provides for some influence over the resilient properties through appropriate selection of the thickness of the chosen sheet material. Preferably, the sheet material and the formed dimensions are such as to allow the spring arms of the electrical contact to be deflected toward each other and recover over numerous cycles.

To retain the contact in the aperture, the contact can include one or more retention members that can engage the insulative housing. For example, in the embodiment illustrated in FIG. 4, the retention member can be configured as a retention wing 200. The retention wing 200 is a structure projecting from the first side 130 of the center portion 120 that extends between a upper shoulder 204 and a lower shoulder 206 and is vertically co-planer to the center portion. A second retention wing 202 can project from the second side 132 of the center portion and extend between a upper and lower shoulder 208, 210 as well. As illustrated in FIG. 13, the first and second retention wings 200, 202 are preferably formed as integral parts of the planer blank.

Figure 14:
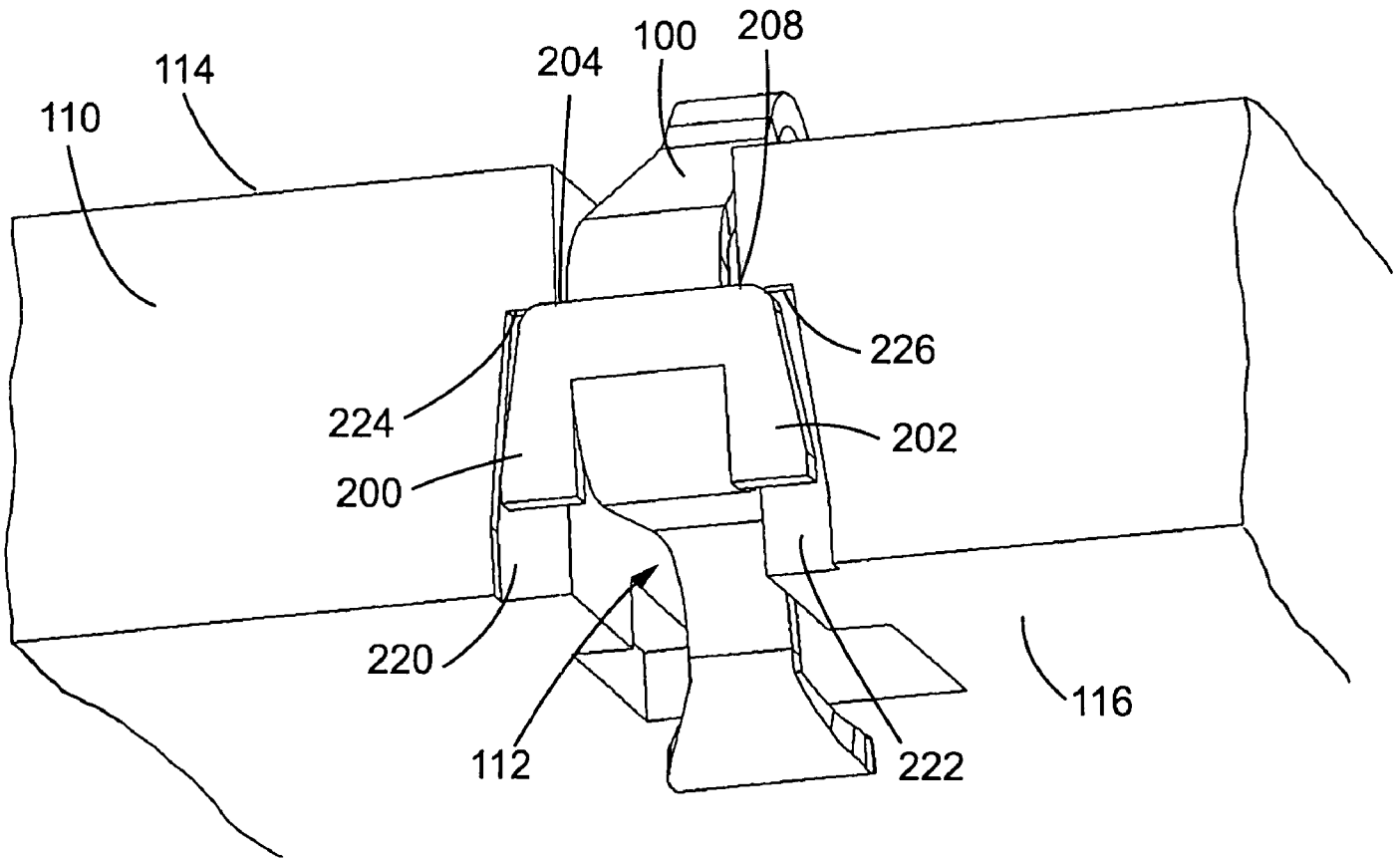
FIG. 14 is a cross-sectional perspective view taken along line 14—14 of FIG. 3 illustrating the contact being retained in the insulative housing.

As illustrated in FIGS. 3 and 14, the retention wings 200, 202, can be received by vertical slots 220, 222 formed on either side of the aperture 112 that considerably widen the aperture at one end. The slots 220,222 are disposed from the second surface 116 part way towards the first surface 114 and terminate at two respective ledges 224, 226. When the contact 100 is inserted into the aperture, the upper shoulders 204, 206 of the retention wings abut against the ledges 224, 226. The dimension of the slots 220, 222 from the second surface 116 to the ledges 224, 226 functions to vertically position the contact within the insulative housing 110.

Figure 15:
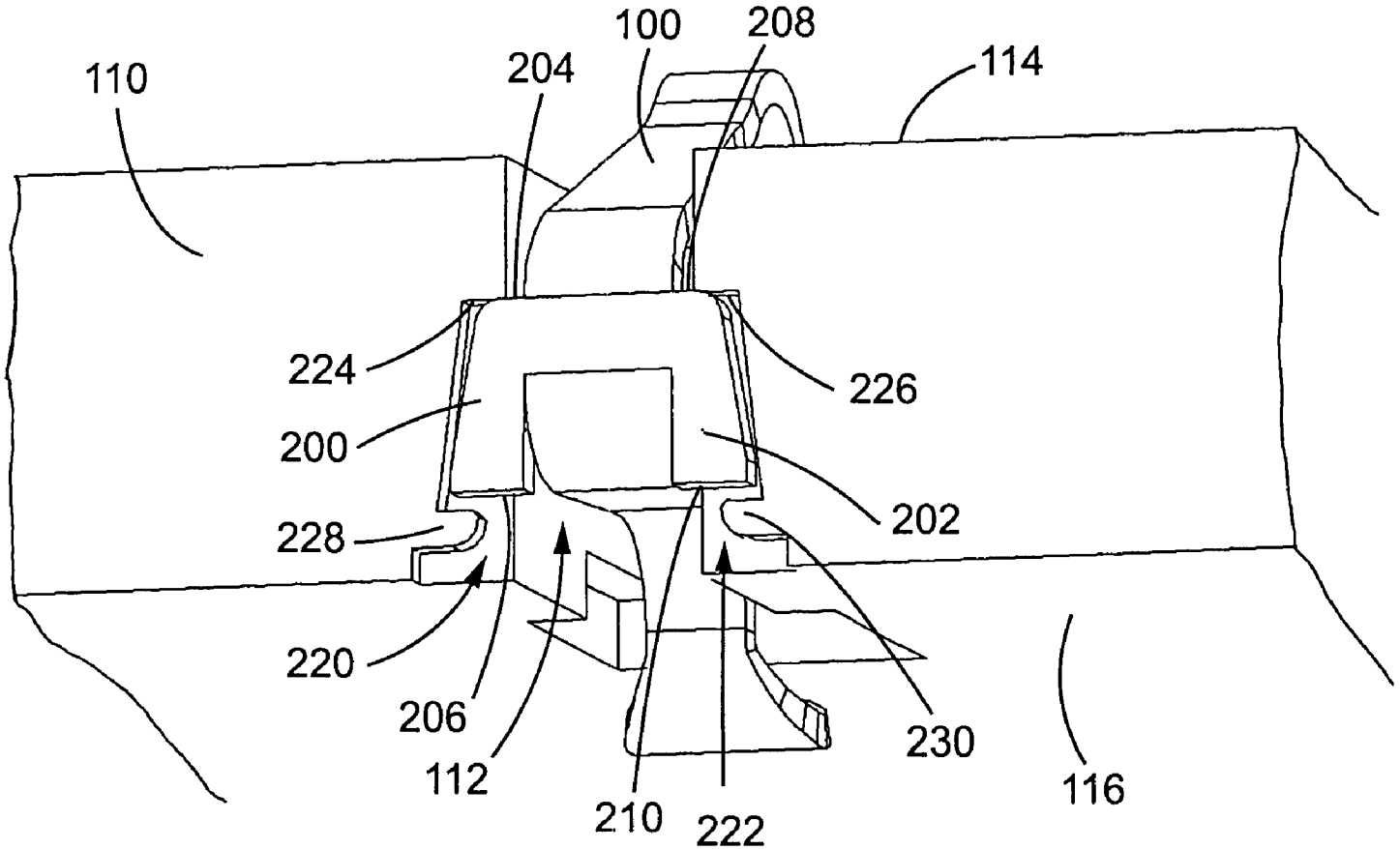
FIG. 15 is a cross-sectional perspective view taken along line 14—14 of FIG. 3 illustrating protuberances being formed into retention slots.

Referring to FIG. 15, to prevent the contact 100 from backing out of the aperture after insertion, two protuberances 228, 230 are formed into the slots proximate to the lower shoulders of the retention wings 200, 202. The protuberances 228, 230 can be formed by deforming the slots 220, 222 after insertion of the contact 100. For this reason, the insulative housing 110 is preferably made from a malleable material that can soften upon localized heating. Accordingly, the retention members 200, 202 are trapped between the ledges 224, 226 and protuberances 228, 230 and the contact is thereby retained in the insulative housing 110.

In a preferred embodiment, the length of the slots 220, 222 between the ledges 224, 226 and the protuberances 228, 230 is slightly larger than the length of the retention wings 200, 202 between the upper shoulders 204, 208 and the respective lower shoulders 206, 210. Also preferably, the size of the slots 220, 222 is larger than the thickness of the sheet metal forming the retention wings 200, 202. Accordingly, the contact is capable of slight vertical and/or horizontal movement with respect to the insulative housing 110 and can therefore float within the aperture 112.

As will be appreciated from FIGS. 7 and 8, an advantage of floating the contact 100 is that the contact can reposition itself within the aperture when the first and second spring arms 140, 160 are deflected together. Accordingly, when the pad 105 presses against the first land surface 142, the floating contact can shift within the aperture 112 so that the width of the first land surface lies substantially across the pad. A similar alignment can occur when the electrical trace 107 is pressed against the second land surface 162. As such, misalignment occurring during insertion of the contact is reduced. A related advantage of allowing the contact to reposition itself is the resulting equalization of the incurred forces and strains between the first and second spring arms.

Figure 16:
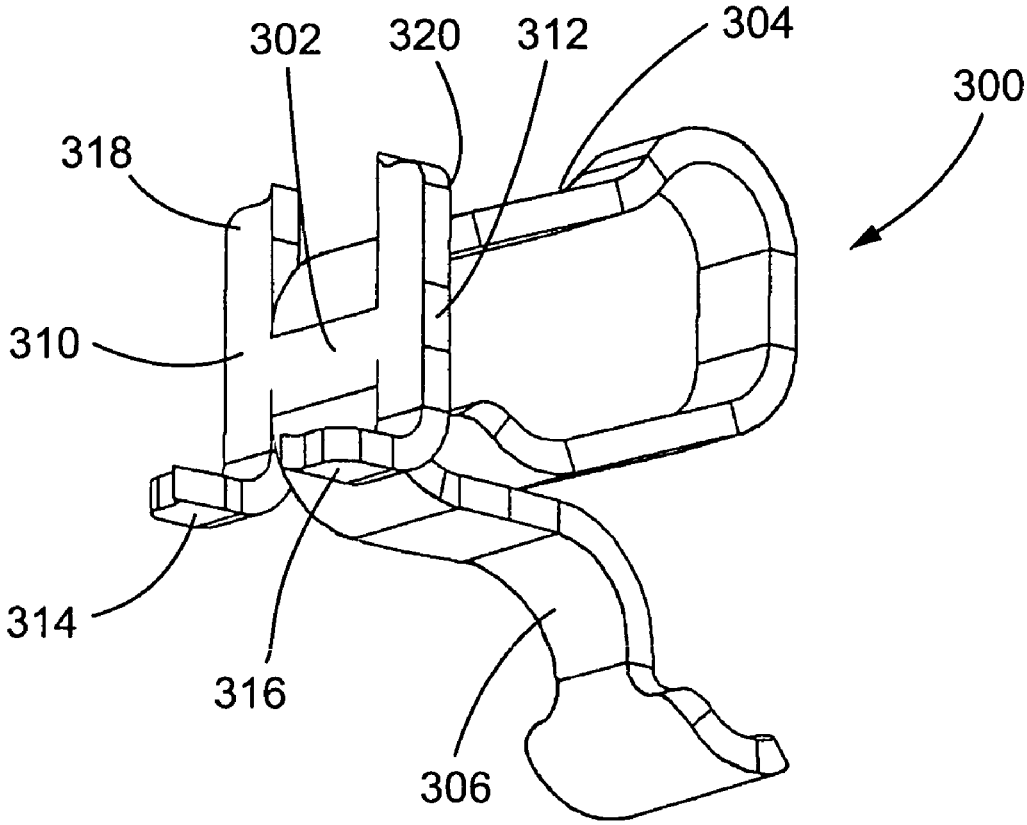
FIG. 16 is a rear perspective view of an embodiment of the contact configured with bendable retention wings.

As illustrated in FIG. 16, in another embodiment of the contact 300, the retention members 310, 312 can be bendable retention posts. Prior to insertion, the retention posts 310, 312 are vertical structures that can extend from both sides of the center portion 302. The retention posts 310, 312 each includes a lower segment 314, 316 that is bent at approximately a right angle with respect to the retention posts. Accordingly, the lower segments 314, 316 are normal to the center portion 302 and project therefrom in a direction generally opposite the direction that the first and second springs arms 304,306 extend. The retention posts 310, 312 each also includes an upper segment 318, 320 that, prior to insertion into the insulative housing, is generally parallel with respect to the plane of the center portion 302. As will be appreciated from FIG. 17, the retention posts 310, 312 can be formed as an integral portion of the stamped blank 324 used to produce the formed contact 300 and accordingly will have the same thickness as the spring arms 304, 306 and center portion 302.

Figure 18:
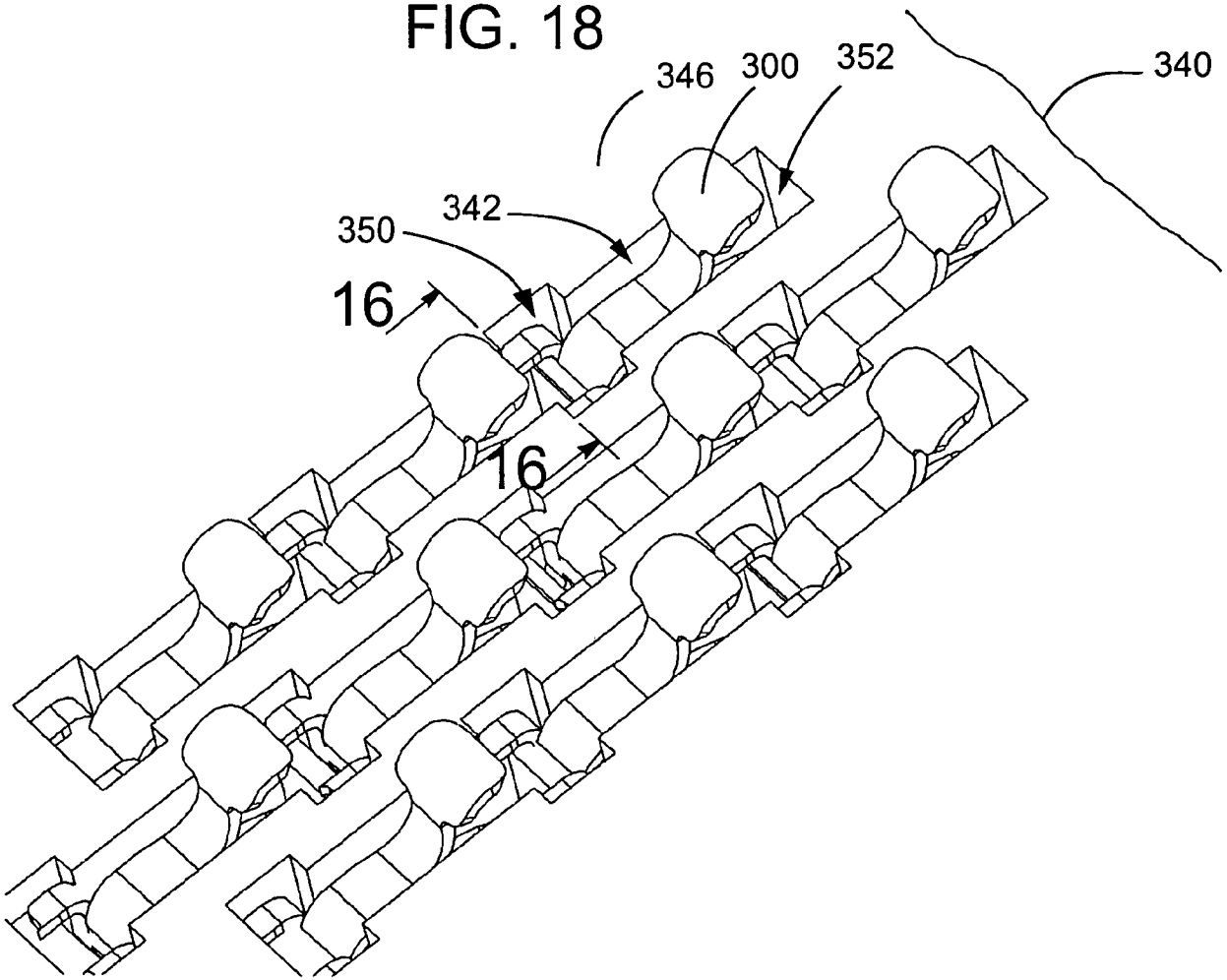
FIG. 18 is a detailed perspective view of the second surface of the insulative housing illustrating the contacts of FIG. 16 retained in the apertures.
Figure 19:
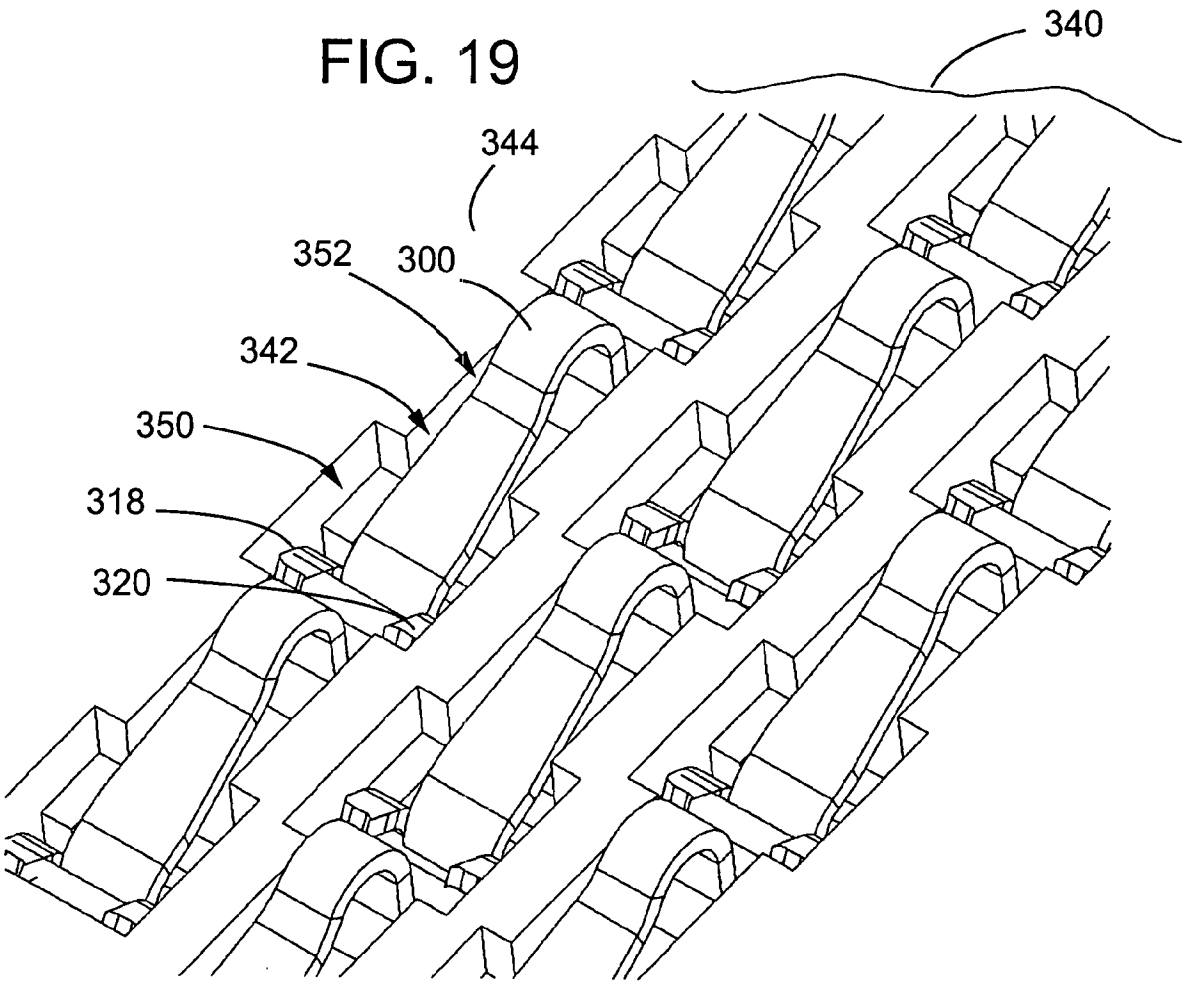
FIG. 19 is a detailed perspective view taken opposite the view illustrated in FIG. 18 illustrating the first surface of the insulative housing.
Figure 20:
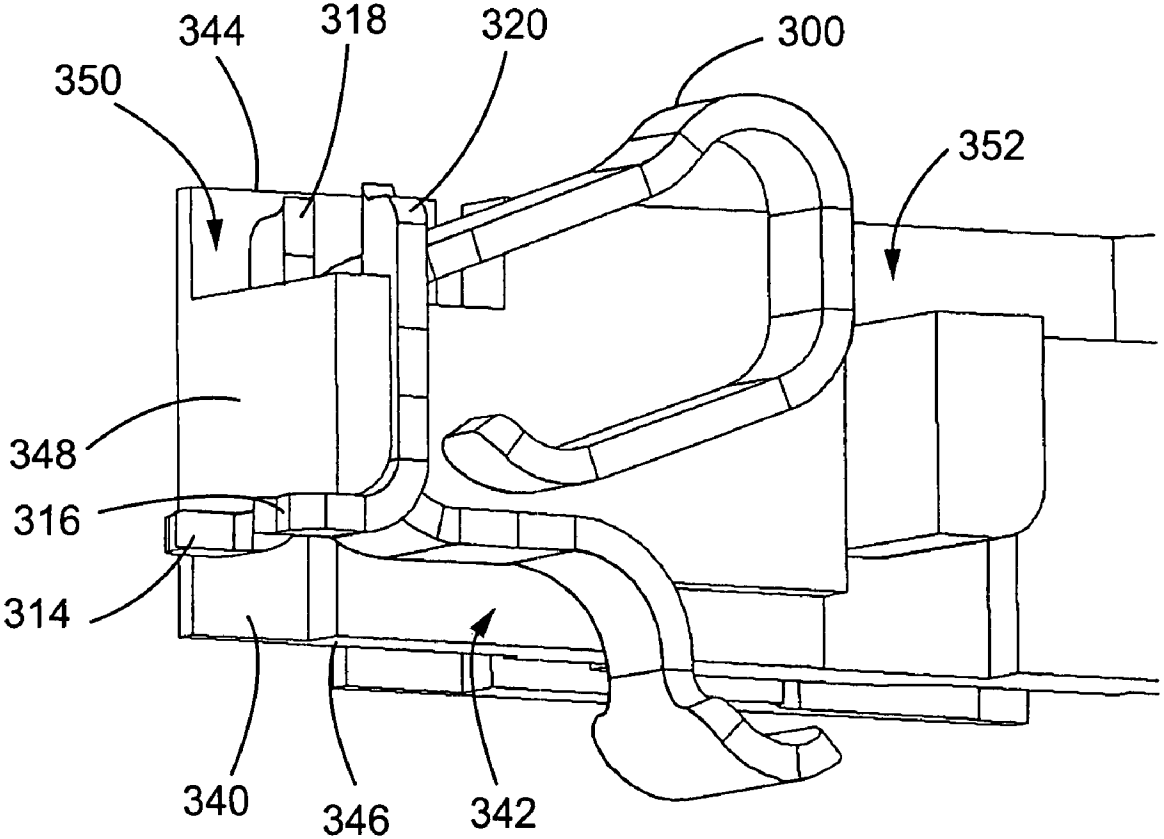
FIG. 20 is a cross-sectional perspective view taken along line 20—20 of FIG. 18 illustrating the bendable retention wings abutting against a sidewall.

To engage the retention posts, as illustrated in FIG. 18, the aperture 342 disposed into the housing 340 is substantially wider at a second end 350 than at the first end 352. Furthermore, as will be appreciated from FIGS. 18 and 19, the wider second end 350 extends further along the overall length of the aperture 342 at the first surface 344 than at the second surface 346. Referring to FIG. 20, the insulative housing 340 includes a sidewall 348 extending across the rear of the second end 350 that is inset from the first and second surfaces 344, 346. When the contact 300 is inserted into the aperture from the second surface 346, the bent lower segments 314, 316 abut against the sidewall 348. Accordingly, the dimension that the sidewall 348 is inset from the second surface 344 functions to vertically position the contact 300 within the insulative housing 340.

Figure 17:
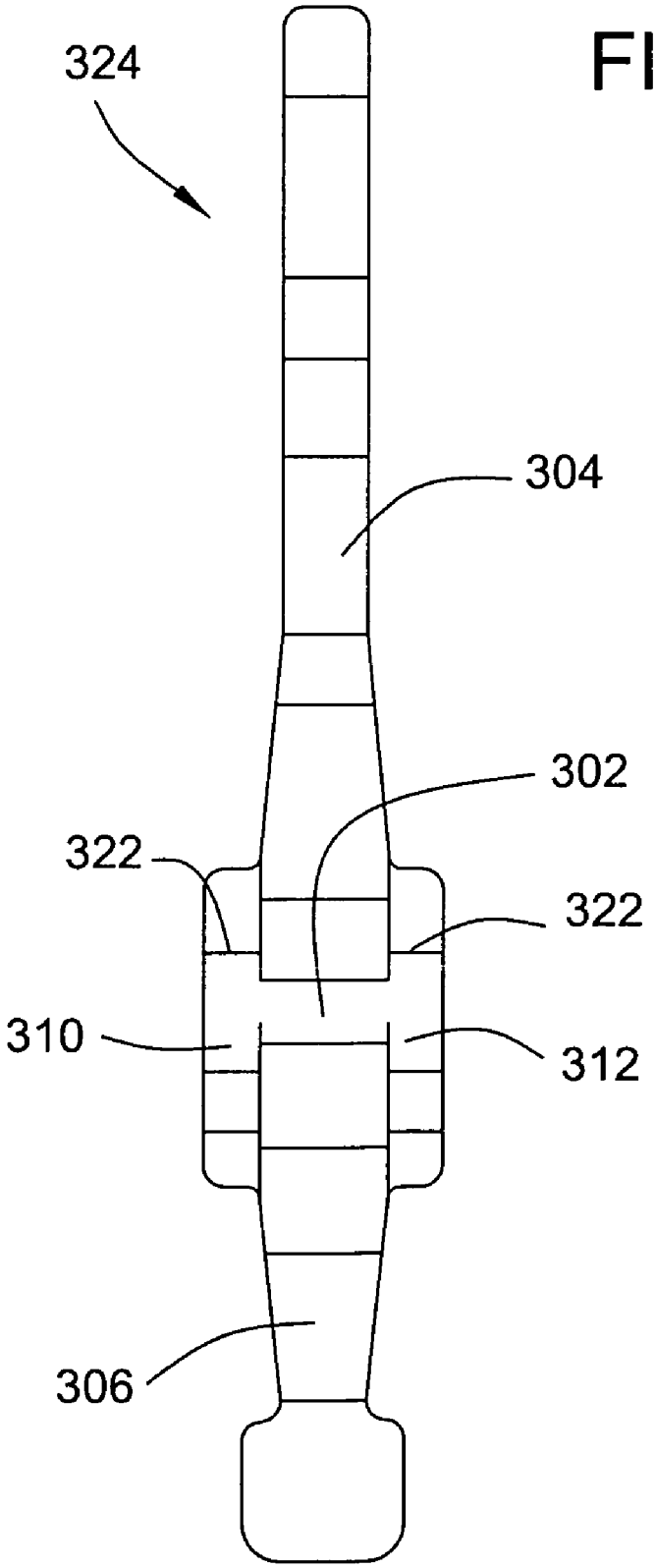
FIG. 17 is a top plan view of a blank stamped from sheet metal that is to be formed into the contact of FIG. 16.
Figure 21:
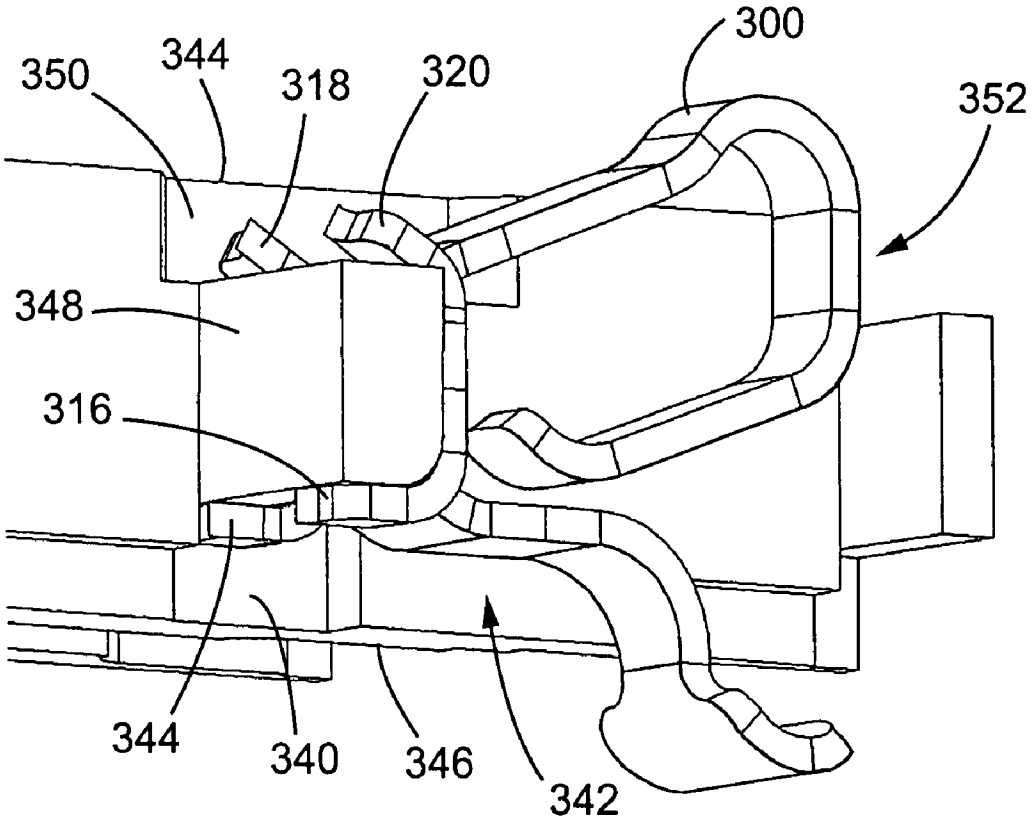
FIG. 21 is a cross-sectional perspective view taken along line 20—20 of FIG. 18 illustrating the retention wings trapping the sidewall.

To prevent the contact 340 from backing out of the aperture 342, as illustrated in FIG. 21, the upper segments 318, 320 of the retention posts can be bent over the sidewall 348. The sidewall 348 is thereby trapped between the upper segments 318, 320 and lower segments 314, 316. Furthermore, as will be appreciated from FIG. 21, by locating the upper segments 318, 320 and lower segments 314, 316 within the wider second end 350 of the aperture 342, the segments do not protrude beyond the first and second surfaces 344, 346 of the insulative housing. To bend the upper segments 318, 320, referring to FIG. 19, a tool can be inserted through the wider second end 350 of the aperture 342 to impinge upon the upper segments 318, 320. For this reason, the wider second end 350 makes up a greater portion of the overall length of the aperture 342 along the first surface 344. Additionally, as illustrated in FIG. 17, to facilitate bending of the upper segments 318, 320 the retention posts can be formed with a score or crease 322 at the appropriate locations.

An advantage of using bendable retention posts 310, 312 to retain the contact 300 within the aperture 342 is that the contact can re-position itself with respect to the aperture. Specifically, as illustrated in FIG. 21, because the upper segments 318, 320 and lower segments 314, 316 trap the sidewall 348 without permanently joining to the sidewall, the contact can float to a certain degree with respect to the aperture 342. Floating the contact, as described above, optimizes contact with the pad on the integrated circuit package and conductive trace on the substrate by enabling the contact to align itself with a pad or conductive trace.

Figure 22:
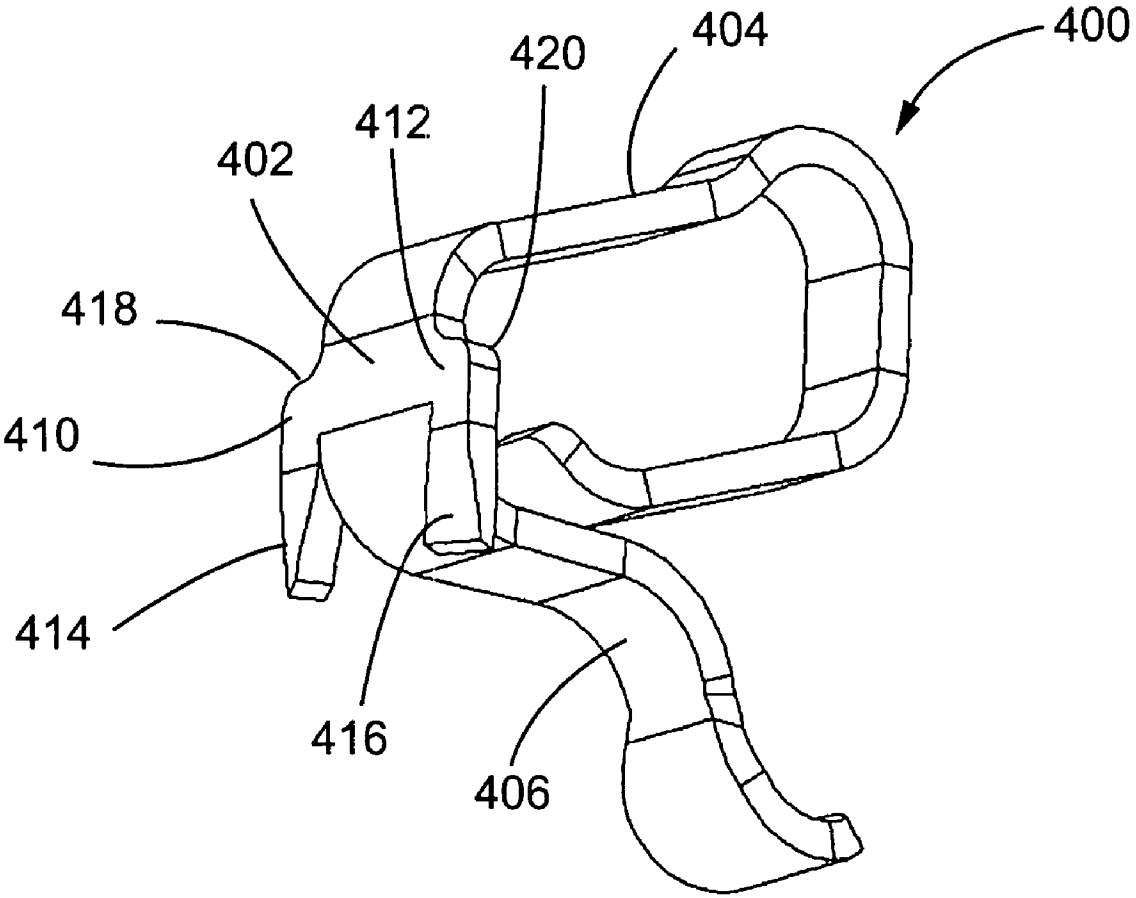
FIG. 22 is a rear perspective view of an embodiment of the contact configured with twist wings.
Figure 23:
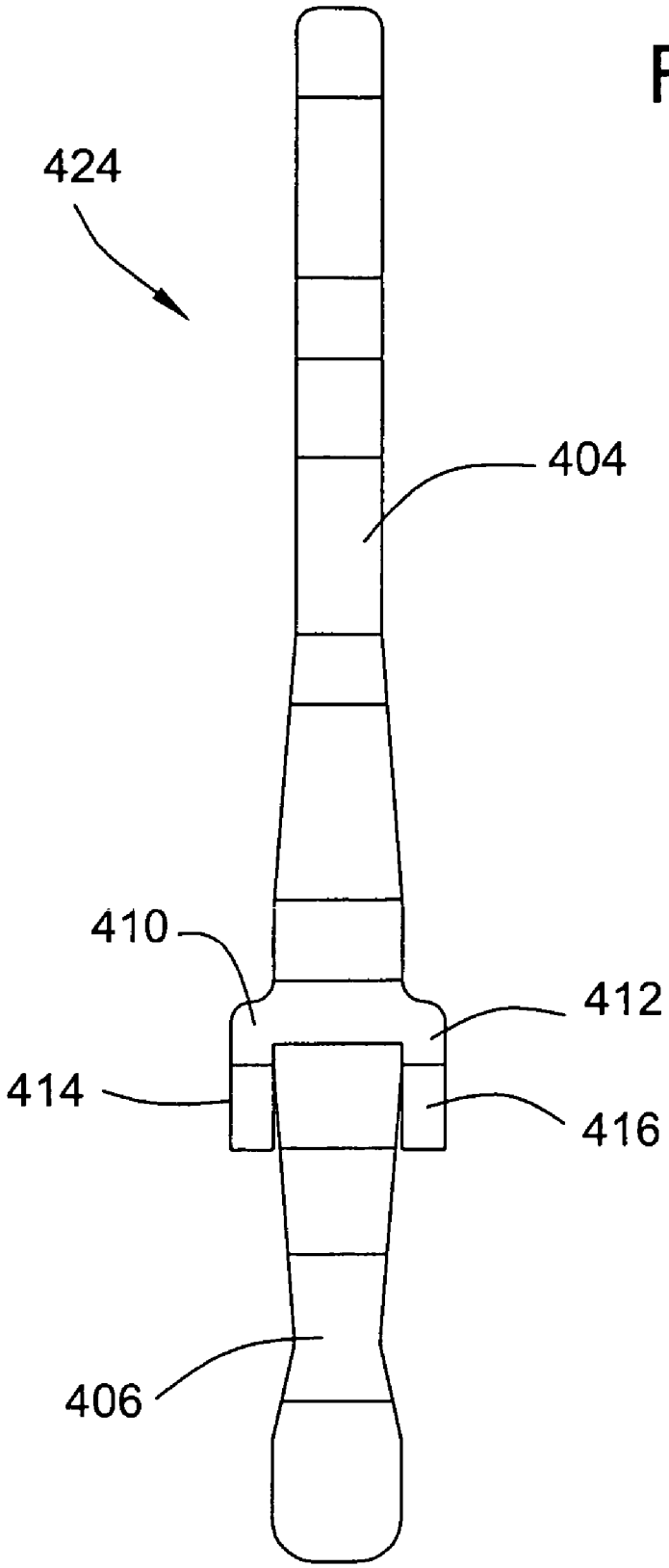
FIG. 23 is a top plan view of a blank stamped from sheet metal that is to be formed into the contact of FIG. 22.

In another embodiment, illustrated in FIG. 22, the contact 400 can include a first and second twist wings 410, 412 projecting from either side of the center portion 402. The twist wings 410, 412 each includes a lower segment 414, 416 that is twisted or turned into the plane of the center portion 402. The twist wings each also includes an upper shoulder 418, 420 that is substantially co-planer with respect to the plane of the center portion 402. Referring to FIG. 23, the twist wings 410, 412 are initially formed as integral portions of the stamped blank 424. During the forming operation that shapes the first and second spring arms 404, 406, a mechanical force is imparted to the lower segments 414, 416 to produce the twisted shaped of the formed twist wings 410, 412.

Figure 24:
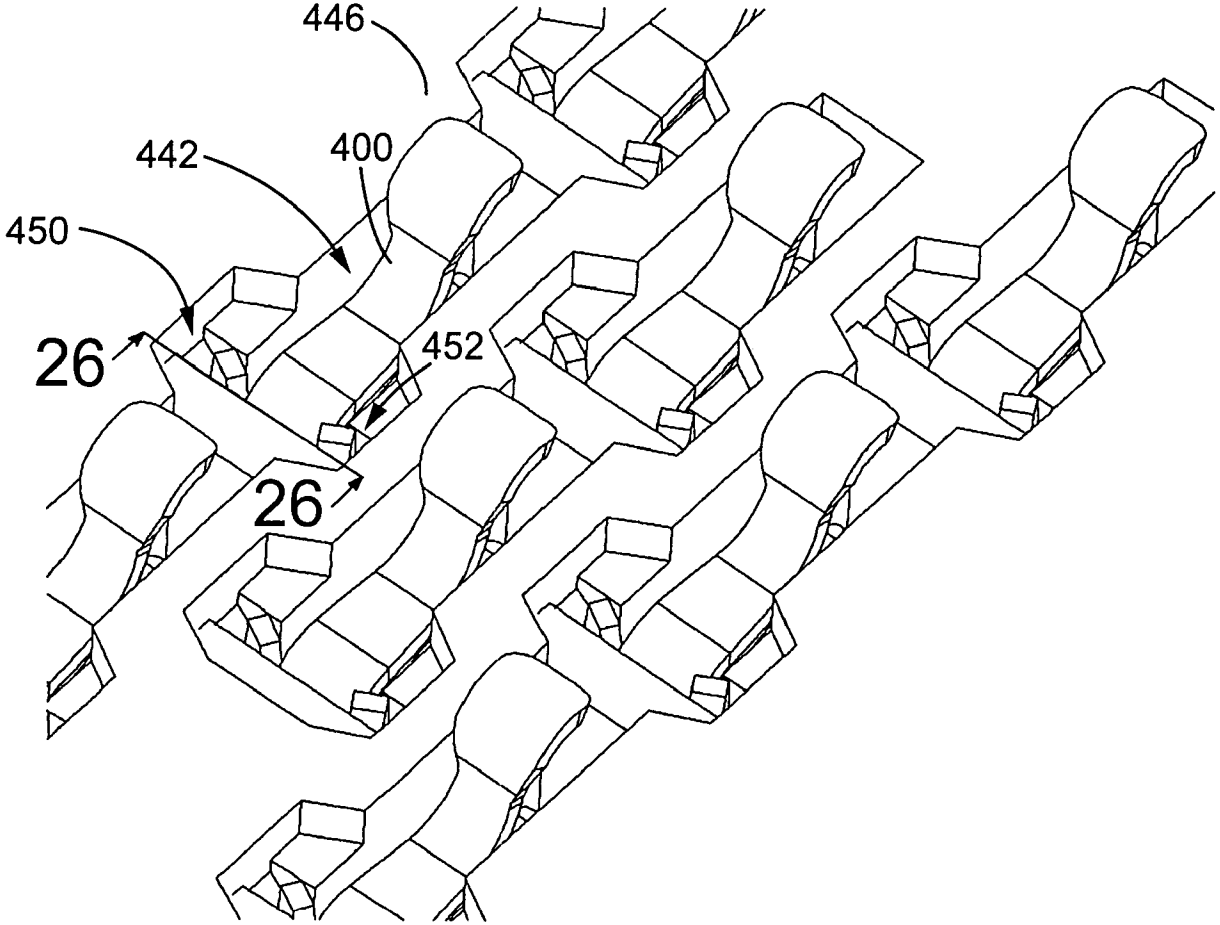
FIG. 24 is a detailed perspective view of the second surface of the insulative housing illustrating the contacts of FIG. 22 retained in the apertures.
Figure 25:
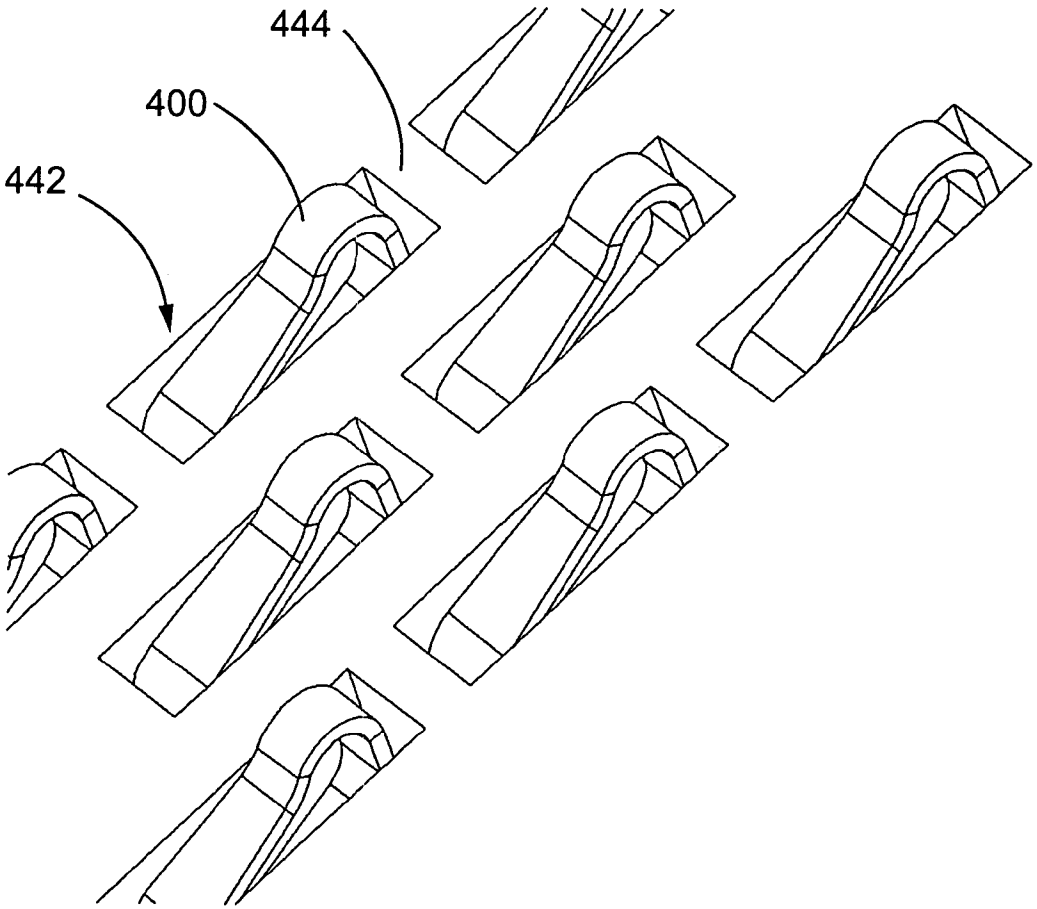
FIG. 25 is a detailed perspective view taken opposite the view illustrated in FIG. 24 illustrating the first surface of the insulative housing.
Figure 26:
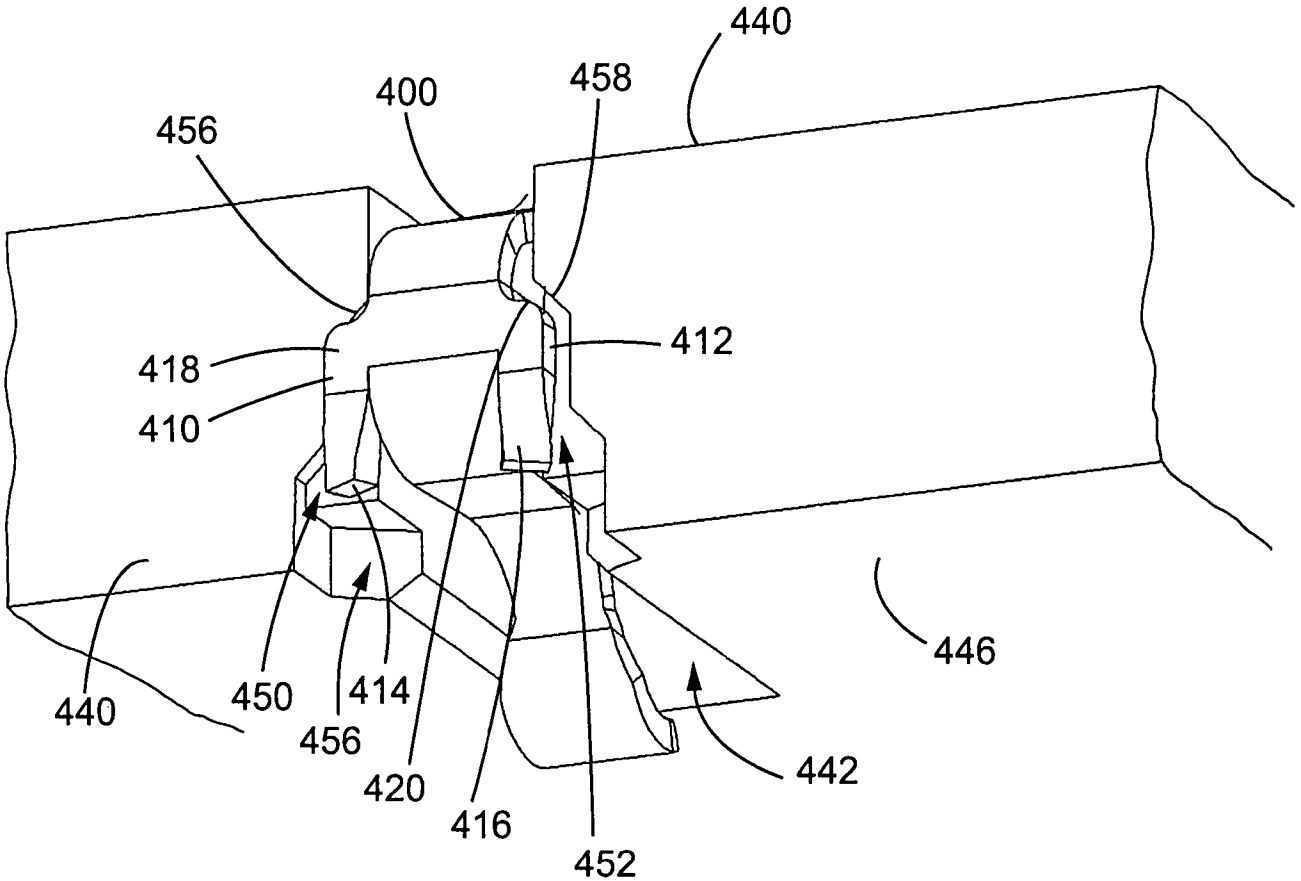
FIG. 26 is a cross-sectional perspective view taken along line 26—26 of FIG. 24 illustrating the contact being retained in the aperture.

To engage the twist wings, as illustrate in FIG. 24, the aperture 442 disposed through the housing 440 includes two slots 450, 452 formed on either side of the aperture. As will be appreciated from FIGS. 24 and 25, the slots are located at a second end 454 of the aperture 442 and extend from the second surface 446 part way towards the first surface 444. Accordingly, as illustrated in FIG. 26, the slots 450, 452 terminate at two respective ledges 456, 458. When the contact 400 is inserted into the aperture 442, the upper shoulders 418, 420 abut against the ledges 456, 458 which thereby establishes the vertical position of the contact with respect to the housing 440.

To prevent the contact 450 from backing out of the aperture 442, the size of the two slots 450, 452 is preferably such that insertion of the twisted lower segments 414, 416 produces an interference fit. Accordingly, the contact 400 is joined to the insulative housing 440 and cannot float with respect to the aperture 442. An advantage of joining the contact to the insulative housing is that the chances of the contact becoming separated are substantially reduced. Additionally, it will be appreciated that no portion of the twist wings 410, 412 protrudes beyond either the first or second surfaces 444, 446 to interfere in establishing electrical contact with a microchip or substrate. To facilitate insertion of the contact, the second end of the aperture 442 can include a depression 456 disposed into the second surface 446 that permits use of an insertion tool.

Figure 27:
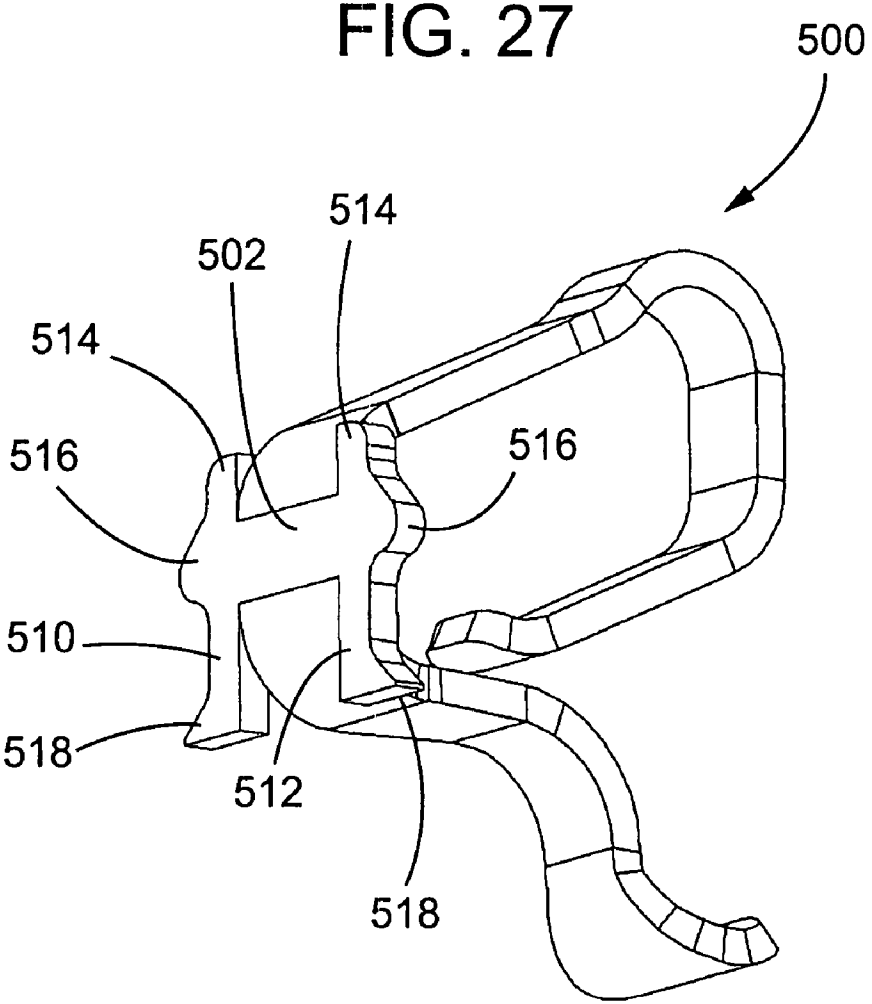
FIG. 27 is a rear perspective view of an embodiment of the contact configured with barbed wings.
Figure 28:
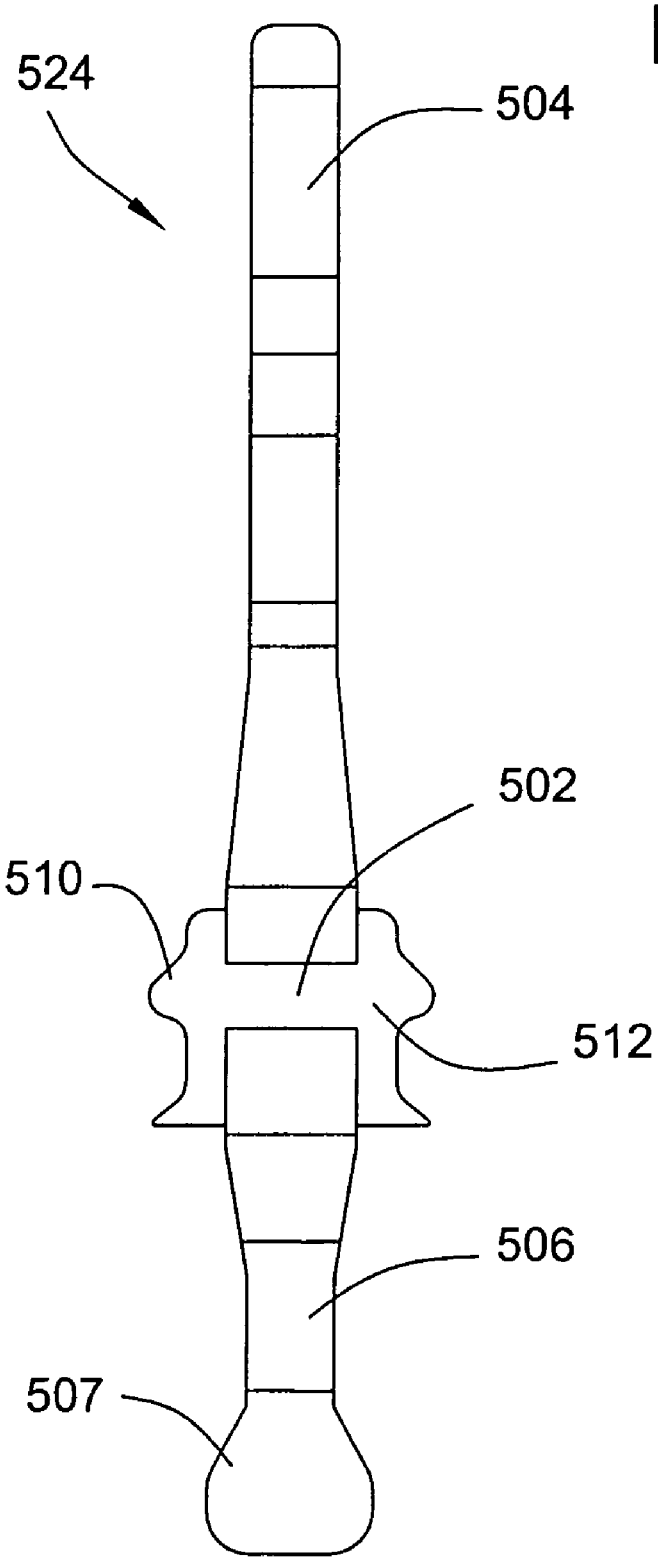
FIG. 28 is a top plan view of a blank stamped from sheet metal that is to be formed into the contact of FIG. 27.

In another embodiment, illustrated in FIG. 27, the contact 500 can include first and second barbed wings 510, 512 projecting from either side of the center portion 502. The first and second barbed wings 510, 512 are generally co-planer with the center portion 502 and include generally vertical post structures 514 that are attached to the center portion. Projecting from the post structure 514 opposite the side attached to the center portion are an upper barb 516 and a lower barb 518. Referring to FIG. 28, the barbed wings 510, 512 can be initially formed as integral portions of the stamped blank 524 along with the upper and lower spring arms 504, 506 and the center portion 502.

Figure 29:
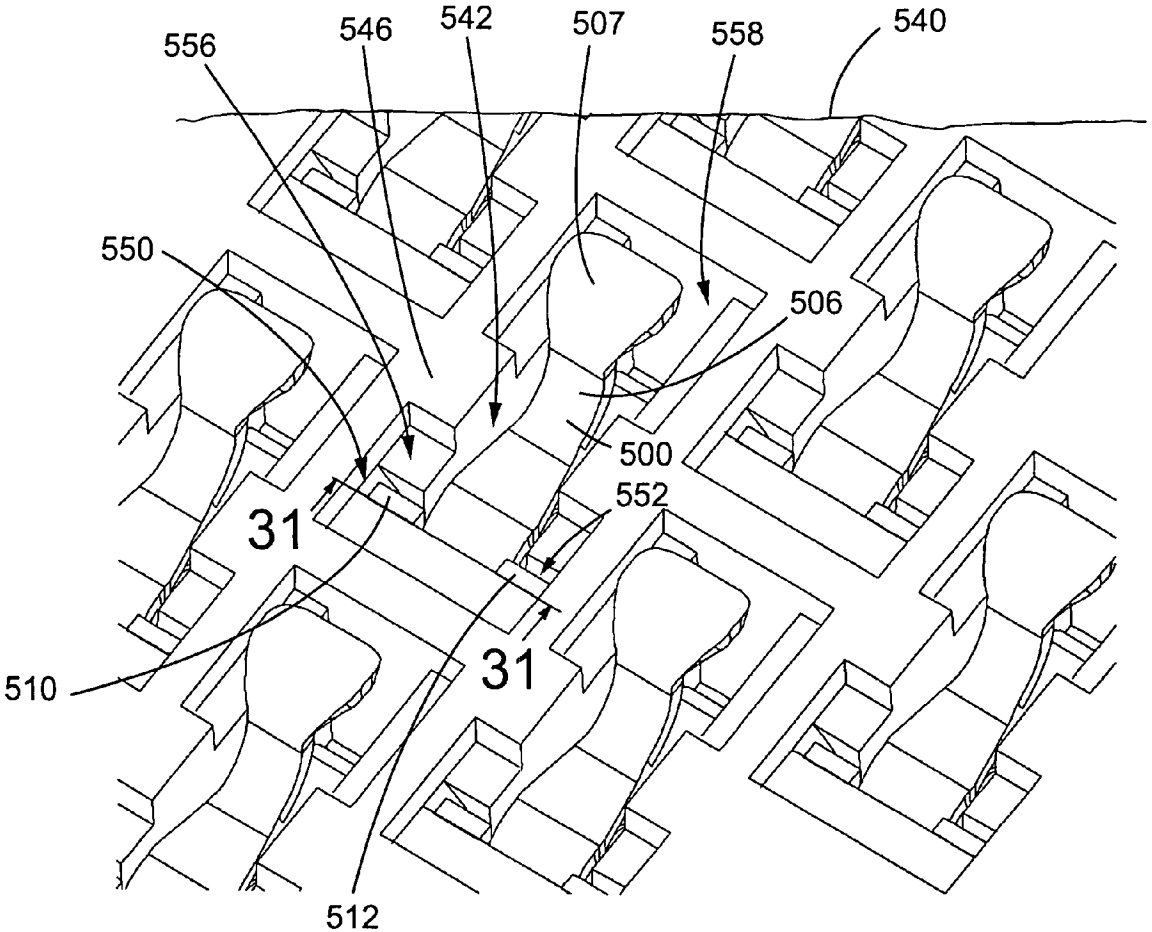
FIG. 29 is a detailed perspective view of the second surface of the insulative housing illustrating the contacts of FIG. 27 retained in the apertures.
Figure 30:
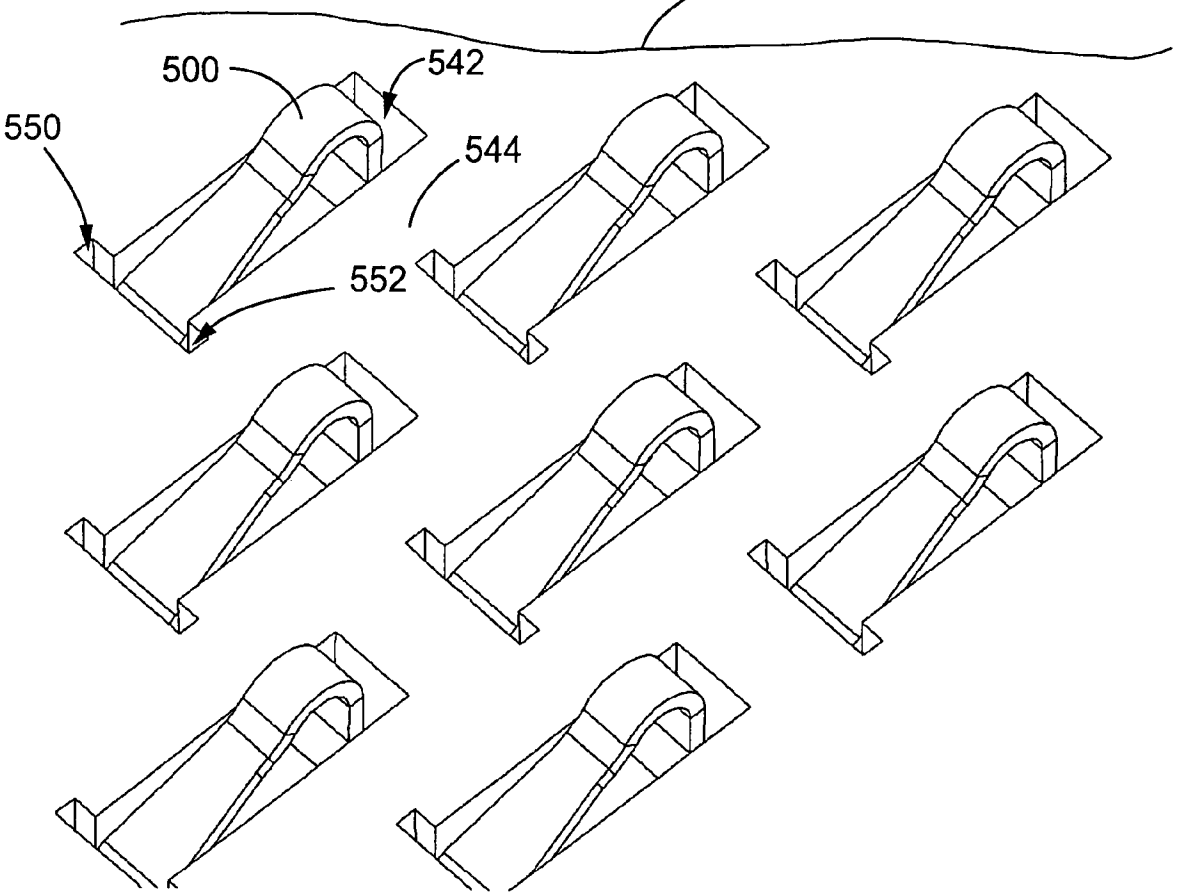
FIG. 30 is a detailed perspective view taken opposite the view illustrated in FIG. 29 illustrating the first surface of the insulative housing.
Figure 31:
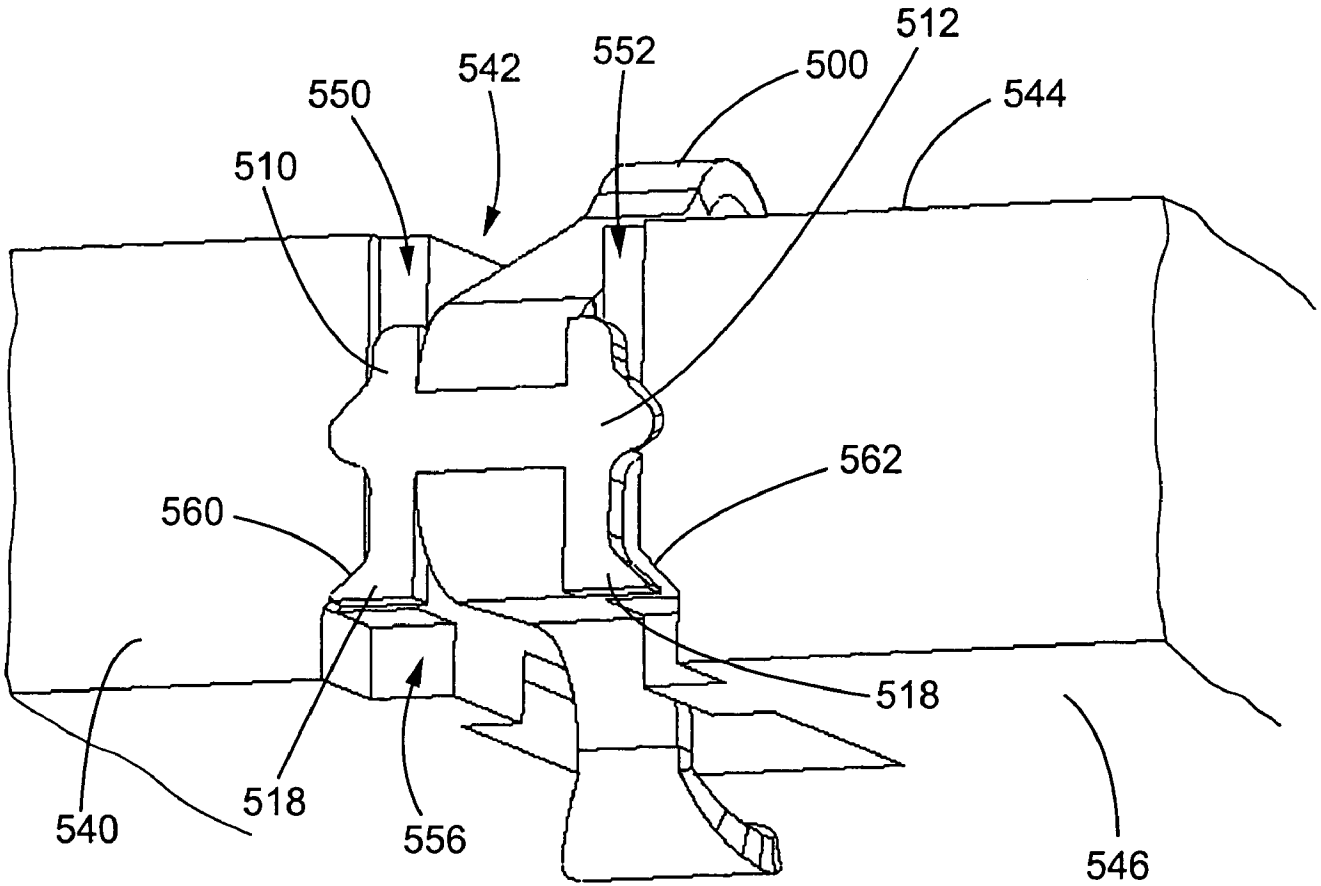
FIG. 31 is a cross-sectional perspective view taken along line 31—31 of FIG. 29 illustrating the contact being retained in the aperture.

To engage the barbed wings 510, 512, as illustrated in FIGS. 29 and 30, the aperture 542 disposed through the insulative housing 540 between the first and second surfaces 544, 546 includes two slots 550, 552 at one end. As illustrated in FIG. 31, when the contact 500 is properly inserted into the aperture 542, the barbed wings 510, 512 are received into the slots 550, 552. Preferably, the size of the slots 550, 552 is such as to create an interference fit with the projecting upper barbs 516. Accordingly, the contact is joined to the insulative housing 540 and cannot float in the aperture 552.

As illustrated in FIG. 29, a first depression 556 is formed into the second surface 546 proximate to the end of the aperture 542 in which the slots 550, 552 are formed. As illustrated in FIG. 31, the depression 556 is considerably wider than the distance between the slots 550, 552 thereby creating a pair of ledges 560, 562 where the depression and slots intersect. Accordingly, when the contact 500 is inserted into the aperture, the lower barbs 518 can abut against the ledges and thereby vertically position the contact with respect to the insulative housing 540. Additionally, it will be appreciated that, in part, because of the depression 556, no portion of the barbed wings 510, 512 protrudes beyond either the first or second surfaces 544, 546 to interfere in establishing electrical contact with a microchip or substrate.

As illustrated in FIG. 29, there is also disposed into the second surface 546 proximate to the aperture a second depression 558. The second depression 558 is located opposite the first depression 556 and provides the aperture 542 with a bar-bell shape at the second surface 546. The second depression 558 considerably widens the aperture 542 to accommodate a second land surface 507 at the end of the lower spring arm 506. Accordingly, as illustrated in FIGS. 28 and 29, the second land surface 507 can be wider than the second spring arm 506 and the center portion 502 and thereby provide more surface area over which electrical contact can be made.

Accordingly, the present invention provides an electrical contact that can be retained within an aperture disposed through an insulative housing. The contact includes two cantilevered spring arms that diverge from a center portion located in the aperture to contact pads or traces placed against either surface of the insulative housing. One spring arm includes a bellows leg that extends proximately to the second spring arm. When the pads and traces are pressed against the housing, the cantilevered spring arms are deflected towards each other and the bellows leg contacts the second spring arm resulting in a shortened electrical path through the contact. In another aspect of the invention, the contact can include retention members that, in an embodiment, floatingly retain the contact within the aperture or, in another embodiment, join the contact to the insulative housing.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments would become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An electrical contact for an electrical connector, the electrical connector including an insulative housing having a first surface, a second surface, and an aperture defining a sidewall, the electrical contact comprising:

a first land surface for projecting beyond the first surface when the electrical contact is inserted into the aperture of the housing, a second land surface for projecting beyond the second surface when the electrical contact is inserted into the aperture of the housing, a center portion, and a bendable retention member projecting from the center, the bendable member including a substantially planar portion that extends a predetermined distance beyond the sidewall when the electrical contact is inserted into the aperture of the housing.

2. The electrical contact of claim 1, wherein the retention member includes a bendable first segment and a second segment, the first segment including the substantially planar portion that extends the predetermined distance beyond the sidewall when the electrical contact is inserted into the aperture of the housing, and the second segment bending at least partially around the sidewall when the electrical contact is inserted into the aperture of the housing.

3. The contact of claim 1, wherein the bendable retention member projects parallel from the center portion.

4. The contact of claim 1 wherein the contact includes:

the center portion defining an upper end and a lower end;

a first spring arm extending at an angled relationship upwards from the upper end, the first spring arm includes the first land surface; and a second spring arm extending from the lower end; the second spring arm including the second land surface.

5. The contact of claim 1, wherein the sidewall includes a first edge, wherein the substantially planar portion of the bendable retention member extends a predetermined distance beyond the first edge of the sidewall when the electrical contact is inserted into the aperture of the housing such that at least part of the substantially planar portion is bendable such that, after the electrical contact is inserted into the aperture of the housing, the substantially planar portion traps the sidewall of the aperture.

6. An electrical connector comprising:

an insulative housing having a first surface, a second surface, and an aperture defining a sidewall; and an electrical contact as defined in claim 1.

7. The electrical contact of claim 1, wherein the electrical contact includes a second bendable retention member projecting from the center portion for trapping the sidewall, the second bendable retention member including a substantially planar portion.

8. The electrical contact of claim 1, wherein the electrical contact includes a second retention member.

9. The electrical contact of claim 1, wherein the contact is formed from a blank stamped from sheet metal.

10. The electrical contact of claim 9, wherein the first land surface and the second land surface both extend from the center portion.

11. The contact of claim 3, wherein the bendable retention member includes an upper trapping segment and a lower trapping segment, the upper trapping segment including the substantially planar portion that extends the predetermined distance beyond the sidewall when the electrical contact is inserted into the aperture of the housing.

12. The contact of claim 11, wherein the bendable upper trapping segment can be bent such that the upper trapping segment and the lower trapping segment are not co-planar to the center portion.

13. The contact of claim 4 wherein the contact includes:

a second contact surface that is located between the lower end and the second land surface; and a bellows leg extending generally downward from the first land surface; the bellows leg including a first contact surface proximate to the second contact surface; whereby deflection of the first and second spring arms towards each other presses the first and second contact surfaces together.

14. The contact of claim 13, wherein a gap separates the first contact surface from the second contact surface.

15. The contact of claim 13, wherein the center portion is generally planar.

16. The contact of claim 13, wherein the first land surface is defined by a bend joining the first spring arm to the bellows leg.

17. The contact of claim 13, wherein the second spring arm curves generally downwards.

18. The contact of claim 17, wherein the second land surface is defined by the curve.

19. The contact of claim 18, wherein the second spring arm terminates at the second land surface.

20. The contact of claim 13, wherein the first contact surface curves generally upwards.

21. The contact of claim 13, wherein the bellows leg terminates at the first contact surface.

22. The contact of claim 21, wherein the bellows leg bends towards the center portion, the bend located between the first land surface and the first contact surface.

23. The contact of claim 13, wherein the first contact surface and the second contact surface are separated by a gap when the first and second spring arms are not deflected toward each other.

24. The contact of claim 13, wherein continued deflection of the first and second spring arms towards each other causes the second contact surface to slide along the bellows leg.

25. The contact of claim 24, wherein the direction of sliding motion of the second contact surface is substantially normal to the direction of deflection of the first and second spring arms.

26. The contact of claim 1 wherein the contact is floatingly retained in at least one aperture.

27. The contact of claim 26, wherein the floating contact can vertically move with respect to the insulative housing.

28. The contact of claim 27, wherein the floating contact can horizontally move with respect to the insulative housing.

29. The contact of claim 26, wherein the contact is stamped and formed from sheet metal.

30. The contact of claim 26, wherein the substantially planar portion of the bendable retention member that extends the predetermined distance from the sidewall when the electrical contact is inserted into the aperture of the housing is bendable such that, after the electrical contact is inserted into the aperture of the housing, the substantially planar portion traps the sidewall of the aperture for floatingly retaining the contact in the aperture.

31. The contact of claim 9, wherein the sheet metal is Beryllium Copper (BeCU).

32. The contact of claim 5, wherein the sidewall includes a second edge, the retention member includes a first segment and a second segment, the first segment including the substantially planar portion that extends the predetermined distance beyond the sidewall when the electrical contact is inserted into the aperture of the housing, and the second segment bending at least partially around the second edge of the sidewall when the electrical contact is inserted into the aperture of the housing.

33. The contact of claim 5, wherein the sidewall includes a second edge, the retention member includes a first segment and a second segment, the first segment including the substantially planar portion that extends the predetermined distance beyond the sidewall when the electrical contact is inserted into the aperture of the housing, the first and second segments disposable such that the first and second edges are disposed between the first and second segments.

34. The electrical contact of claim 2, wherein the electrical contact includes a second bendable retention member projecting from the center portion for trapping the sidewall, the second bendable retention member including a substantially planar portion, wherein the second retention member includes a bendable first segment and a second segment, the first segment of the second retention member including the substantially planar portion, and the second segment of the second retention member bending at least partially around the sidewall when the electrical contact is inserted into the aperture of the housing.

35. The electrical contact of claim 3, wherein the electrical contact includes a second bendable retention member projecting from the center portion for trapping the sidewall, the second bendable retention member including a substantially planar portion, wherein the second bendable retention members project parallel from the center portion.

36. The electrical contact of claim 35, wherein the first bendable retention member includes an upper trapping segment and a lower trapping segment, the upper trapping segment including the substantially planar portion that extends the predetermined distance beyond the sidewall when the electrical contact is inserted into the aperture of the housing, wherein the second bendable retention member includes a second upper trapping segment and a second lower trapping segment, the second upper trapping segment including the substantially planar portion of the second retention member.

37. The electrical contact of claim 36, wherein the first bendable upper trapping segment can be bent such that the first upper trapping segment and the first lower trapping segment are not co-planar to the center portion, wherein the second bendable upper trapping segment can be bent such that the second upper trapping segment and the second lower trapping segment are not co-planar to the center portion.

38. The electrical contact of claim 7, wherein the contact is floatingly retained in at least one aperture.

39. The electrical contact of claim 38, wherein the substantially planar portions of the first and second bendable retention members are bendable such that, after the electrical contact is inserted into the aperture of the housing, the substantially planar portions trap the sidewall of the aperture for floatingly retaining the contact in the aperture.

40. The contact of claim 7, wherein the sidewall includes a first edge, wherein the substantially planar portions of the first and second bendable retention members extend predetermined distances beyond the first edge of the sidewall when the electrical contact is inserted into the aperture of the housing such that at least part of the substantially planar portions are bendable such that, after the electrical contact is inserted into the aperture of the housing, the substantially planar portions trap the sidewall of the aperture.

41. The contact of claim 40, wherein the sidewall includes a second edge, the first retention member includes a first segment and a second segment, the first segment including the substantially planar portion, and the second segment bending at least partially around the second edge of the sidewall when the electrical contact is inserted into the aperture of the housing, wherein the second retention member includes a first segment and a second segment, the first segment of the second retention member including the substantially planar portion, and the second segment of the second retention member bending at least partially around the second edge of the sidewall when the electrical contact is inserted into the aperture of the housing.

42. The electrical contact of claim 40, wherein the sidewall includes a second edge, the first retention member includes a first segment and a second segment, the first segment including the substantially planar portion that extends the predetermined distance beyond the sidewall when the electrical contact is inserted into the aperture of the housing, the first and second segments disposable such that the first and second edges are disposed between the first and second segments of the first retention member, wherein the second retention member includes a first segment and a second segment, the first segment of the second retention member including the substantially planar portion, the first and second segments of the second retention member disposable such that the first and second edges are disposed between the first and second segments of the second retention member.

43. A method for assembling an electrical connector, the method comprising the steps of:

providing an insulative housing including a first surface, a second surface, and an aperture defining a sidewall with an edge;

providing an electrical contact including a first land surface, a second land surface, a center portion, and a first retention member extending from the center portion, the first retention member having a distal end;

inserting the electrical contact into the aperture of the housing such that the first land surface extends from the first surface, the second land surface extends from the second surface, and the distal end of the first retention member extends beyond the edge of the sidewall by a predetermined distance; and bending at least a portion of the first retention member around the edge of the sidewall to thereby mount the electrical contact to the housing.

44. The method of claim 43, wherein the electrical contact includes a second retention member with a second distal end that extends beyond the edge of the sidewall by a predetermined distance when the contact is inserted into the aperture and further comprising the step of:

bending at least a portion of the second retention member around the edge of the sidewall to thereby mount the electrical contact to the housing.

45. The method of claim 43, wherein the first land surface and the second land surface both extend from the center portion.

46. The method of claim 43, wherein the bendable retention member projects parallel from the center portion.

47. The method of claim 43, wherein the bendable retention member includes an upper trapping segment and a lower trapping segment, the upper trapping segment including a substantially planar portion defining the distal end that extends the predetermined distance beyond the sidewall when the electrical contact is inserted into the aperture of the housing.

48. The method of claim 43, wherein the contact includes:

the center portion defining an upper end and a lower end;

a first spring arm extending at an angled relationship upwards from the upper end, the first spring arm includes the first land surface; and a second spring arm extending from the lower end; the second spring arm including the second land surface.

49. The method of claim 43, wherein the contact is floatingly retained in the aperture after the first retention member is bent around the edge.

50. The method of claim 43, wherein the sidewall includes a second edge, the retention member includes a first segment and a second segment, the first segment including the distal end that extends the predetermined distance beyond the sidewall when the electrical contact is inserted into the aperture of the housing.

51. The method of claim 43, wherein the sidewall includes a second edge, the retention member includes a first segment and a second segment, the first segment including the distal end that extends the predetermined distance beyond the sidewall when the electrical contact is inserted into the aperture of the housing, the first and second segments disposable such that the first and second edges are disposed between the first and second segments.

52. The method of claim 43, wherein the electrical contact includes a second retention member.

53. The method of claim 47, wherein the bendable upper trapping segment can be bent such that the upper trapping segment and the lower trapping segment are not co-planar to the center portion.

54. The method of claim 48, wherein the contact includes:

a second contact surface that is located between the lower end and the second land surface; and a bellows leg extending generally downward from the first land surface; the bellows leg including a first contact surface proximate to the second contact surface; whereby deflection of the first and second spring arms towards each other presses the first and second contact surfaces together.

55. The method of claim 54, wherein a gap separates the first contact surface from the second contact surface.

56. The method of claim 55, further comprising the step of:

deflecting the first spring arm and the second spring towards one another such that the gap is eliminated and the first contact surface and the second contact surface touch.

57. The method of claim 54, wherein the center portion is generally planar.

58. The method of claim 54, wherein the first land surface is defined by a bend joining the first spring arm to the bellows leg.

59. The method of claim 54, wherein the second spring arm curves generally downwards.

60. The method of claim 59, wherein the second land surface is defined by the curve.

61. The method of claim 60, wherein the second spring arm terminates at the second land surface.

62. The method of claim 54, wherein the first contact surface curves generally upwards.

63. The method of claim 54, wherein the bellows leg terminates at the first contact surface.

64. The method of claim 63, wherein the bellows leg bends towards the center portion, the bend located between the first land surface and the first contact surface.

65. The method of claim 56 further comprising the step of:

further deflecting the first and second spring arms towards each other such that the second contact surface slides along the bellows leg.

66. The method of claim 65, wherein the direction of sliding motion of the second contact surface is substantially normal to the direction of deflection of the first and second spring arms.

67. The method of claim 49, wherein the contact can vertically move with respect to the insulative housing after the contact is mounted to the housing.

68. The method of claim 67, wherein the contact can horizontally move with respect to the insulative housing after the contact is mounted to the housing.

69. The method of claim 49, wherein after the distal end of the bendable retention member is bent around the sidewall, the distal end traps the sidewall of the aperture for floatingly retaining the contact in the aperture.

70. The method of claim 50, wherein the second segment bends at least partially around the second edge of the sidewall when the electrical contact is inserted into the aperture of the housing.

71. The method of claim 50, further comprising the step of:

after the contact is inserted into the aperture of the housing, bending the second segment of the retention member around the second edge of the sidewall.

72. The method of claim 46, wherein the electrical contact includes a second retention member with a second distal end, wherein the second bendable retention member projects parallel from the center portion.

73. The method of claim 47, wherein the electrical contact includes a second retention member with a second distal end, wherein the second bendable retention member includes a second upper trapping segment and a second lower trapping segment, the second upper trapping segment including a substantially planar portion defining the second distal end.

74. The method of claim 73, wherein the bendable upper trapping segments of the first and second retention members can be bent such that the upper trapping segments and the lower trapping segments are not co-planar to the center portion.

75. The method of claim 49, wherein the electrical contact includes a second retention member with a second distal end, wherein the contact is floatingly retained in the aperture after the second retention member is bent around the edge.

76. The method of claim 75, wherein after the first and second distal ends of the bendable retention members are bent around the sidewall, the distal ends trap the sidewall of the aperture for floatingly retaining the contact in the aperture.

77. The method of claim 50, wherein the electrical contact includes a second retention member with a second distal end, wherein the second retention member includes a first segment and a second segment, the first segment of the second retention member including the second distal end.

78. The method of claim 77, wherein the second segments of the first and second retention members bend at least partially around the second edge of the sidewall when the electrical contact is inserted into the aperture of the housing.

79. The method of claim 77, further comprising the step of:

after the contact is inserted into the aperture of the housing, bending the second segments of the first and second retention members around the second edge of the sidewall.

80. The method of claim 51, wherein the electrical contact includes a second retention member with a second distal end, the second retention member includes a first segment and a second segment, the first segment of the second retention member including the second distal end, the first and second segments of the second retention member disposable such that the first and second edges are disposed between the first and second segments of the second retention member.

* * * * *

UNITED STATES PATENT AND TRADEMARK OFFICE

CERTIFICATE OF CORRECTION

PATENT NO. : 7,094,066 B2
APPLICATION NO. : 11/028855
DATED : August 22, 2006
INVENTOR(S) : Mendenhall et al.

It is certified that error appears in the above-identified patent and that said Letters Patent is hereby corrected as shown below:

In Column 2, Line 8: “deflect” should read --deflect.--.

Column 12, line 42, “from the center” should read --from the center portion--.

Column 12, line 45: “housing.” should read --housing; wherein the bendable member is bent after the electrical contact is seated in the aperture for trapping the sidewall.--

Signed and Sealed this

Fifteenth Day of April, 2008

JON W. DUDAS
*Director of the United States Patent and Trademark Office*